US007438172B2

(12) United States Patent
Long et al.

(10) Patent No.: US 7,438,172 B2
(45) Date of Patent: Oct. 21, 2008

(54) FOREIGN OBJECT REMOVAL SYSTEM FOR A COIN PROCESSING DEVICE

(75) Inventors: Arthur J. Long, Palatine, IL (US); Gary W. Cooper, Plainfield, IL (US); John R. Blake, St. Charles, IL (US); JohnMark Mobley, Prospect Heights, IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 111 days.

(21) Appl. No.: 11/267,090

(22) Filed: Nov. 4, 2005

(65) Prior Publication Data

US 2006/0054457 A1 Mar. 16, 2006

Related U.S. Application Data

(63) Continuation-in-part of application No. 10/459,649, filed on Jun. 11, 2003.

(60) Provisional application No. 60/388,843, filed on Jun. 14, 2002.

(51) Int. Cl.
*G07F 1/04* (2006.01)

(52) U.S. Cl. ..... 194/347

(58) Field of Classification Search ..... 194/347, 194/344, 350; 453/57, 63
See application file for complete search history.

(56) References Cited

U.S. PATENT DOCUMENTS

| | | | | |
|---|---|---|---|---|
| 2,289,002 A | | 7/1942 | Fleming et al. | 133/8 |
| 3,373,542 A | | 3/1968 | Ikeuchi | 53/159 |
| 3,757,805 A | | 9/1973 | Puhahn et al. | 133/8 |
| 4,172,462 A | | 10/1979 | Uchida et al. | 133/3 |
| 4,360,034 A | | 11/1982 | Davila et al. | 133/3 |
| 4,586,522 A | * | 5/1986 | Taipale et al. | 453/10 |
| D294,597 S | | 3/1988 | Lanagan | D18/3 |
| 4,964,495 A | | 10/1990 | Rasmussen | 194/344 |
| 4,997,406 A | | 3/1991 | Horguchi et al. | 453/57 |
| 5,068,835 A | | 11/1991 | Reed | 367/135 |
| 5,299,977 A | | 4/1994 | Mazur et al. | 453/10 |
| 5,382,191 A | | 1/1995 | Rasmussen | 453/11 |
| 5,429,551 A | | 7/1995 | Uecker et al. | 453/18 |
| 5,435,777 A | | 7/1995 | Takatani et al. | 453/31 |
| 5,443,419 A | | 8/1995 | Adams et al. | 453/17 |

(Continued)

OTHER PUBLICATIONS

Complaint, *Cummins-Allison Corp.* v. *Glory Ltd., Glory Shoji Co. Ltd., and Glory (U.S.A) Inc.*, Civil Action No. 02C-7008, United States District Court, Northern District of Illinois, Eastern Division.

(Continued)

*Primary Examiner*—Patrick Mackey
*Assistant Examiner*—Mark Beauchaine
(74) *Attorney, Agent, or Firm*—Nixon Peabody LLP

(57) ABSTRACT

A coin processing system includes a coin input area for receiving coins from a user, and a coin processing module for receiving and counting the coins from the coin input area. The coin processing module includes a coin hopper, a coin processing area, and a foreign object removal system. The coin hopper receives the coins from the coin input area. The coin processing area receives and counts the coins from the coin hopper. The foreign object removal system is located at least partially within the coin hopper, and removes a foreign object from the coin hopper subsequent to receiving the foreign object from the coin input area.

40 Claims, 20 Drawing Sheets

U.S. PATENT DOCUMENTS

| | | | | |
|---|---|---|---|---|
| 5,453,047 | A | 9/1995 | Mazur et al. | 453/10 |
| 5,465,822 | A | 11/1995 | DeWoolfson et al. | 194/209 |
| 5,507,379 | A | 4/1996 | Mazur et al. | 194/318 |
| 5,542,880 | A | 8/1996 | Geib et al. | 453/10 |
| 5,564,546 | A | 10/1996 | Molbak et al. | 194/216 |
| 5,620,079 | A | 4/1997 | Molbak | 194/217 |
| 5,746,299 | A | 5/1998 | Molbak et al. | 194/200 |
| 5,799,767 | A | 9/1998 | Molbak | 194/217 |
| 5,842,916 | A | 12/1998 | Gerrity et al. | 453/57 |
| 5,865,673 | A | 2/1999 | Geib et al. | 453/10 |
| 5,909,793 | A | 6/1999 | Beach et al. | 194/210 |
| 5,909,794 | A | 6/1999 | Molbak et al. | 194/216 |
| 5,945,602 | A | 8/1999 | Ross | 73/570 |
| 5,957,262 | A | 9/1999 | Molbak et al. | 194/200 |
| 5,979,240 | A | 11/1999 | Rix et al. | 73/602 |
| 5,988,348 | A | 11/1999 | Martin et al. | 194/317 |
| 5,997,395 | A | 12/1999 | Geib et al. | 453/10 |
| 6,021,883 | A | 2/2000 | Casanova et al. | 194/217 |
| 6,047,807 | A | 4/2000 | Molbak | 194/217 |
| 6,047,808 | A | 4/2000 | Neubarth et al. | 194/317 |
| 6,056,104 | A | 5/2000 | Neubarth et al. | 194/317 |
| 6,068,550 | A * | 5/2000 | Breitholtz et al. | 453/17 |
| 6,079,262 | A | 6/2000 | Palomeque et al. | 73/163 |
| 6,082,519 | A | 7/2000 | Martin et al. | 194/350 |
| 6,093,094 | A | 7/2000 | Uecker et al. | 453/16 |
| 6,095,313 | A | 8/2000 | Molbak et al. | 194/344 |
| 6,116,402 | A | 9/2000 | Beach et al. | 194/216 |
| 6,139,419 | A * | 10/2000 | Abe | 453/17 |
| 6,168,001 | B1 | 1/2001 | Davis | 194/200 |
| 6,174,230 | B1 | 1/2001 | Gerrity et al. | 453/57 |
| 6,196,371 | B1 | 3/2001 | Martin et al. | 194/317 |
| 6,225,902 | B1 | 5/2001 | Gahan | 340/540 |
| 6,264,545 | B1 | 7/2001 | Magee et al. | 453/3 |
| 6,318,537 | B1 | 11/2001 | Jones et al. | 194/346 |
| 6,349,972 | B1 | 2/2002 | Geiger et al. | 283/67 |
| 6,438,230 | B1 | 8/2002 | Moore | 380/42 |
| 6,471,030 | B1 | 10/2002 | Neubarth et al. | 194/317 |
| 6,484,863 | B1 | 11/2002 | Molbak | 194/216 |
| 6,484,884 | B1 | 11/2002 | Gerrity et al. | 209/223 |
| 6,494,776 | B1 | 12/2002 | Molbak | 453/32 |
| 6,520,308 | B1 | 2/2003 | Martin et al. | 194/317 |
| 6,558,245 | B2 * | 5/2003 | Abe et al. | 453/57 |
| 6,602,125 | B2 * | 8/2003 | Martin | 453/12 |
| 6,783,452 | B2 * | 8/2004 | Hino et al. | 453/3 |
| 2003/0062243 | A1 | 4/2003 | Mattice | 194/328 |
| 2003/0075414 | A1 | 4/2003 | Gerrity et al. | 194/347 |
| 2003/0127299 | A1 | 7/2003 | Jones et al. | 194/217 |

OTHER PUBLICATIONS

Billcon Corporation, Brochure for CCS-60/CCS-80 Series Coin Counter-Sorter, 2 pages (Oct. 1999).

Billcon Corporation, Photos for CCS-60/80, 1 page (Japanese language) (Oct. 12, 2000).

De La Rue Cash Systems, Inc., Brochure for ACD Automatic Coin Dispenser, 2 pages, no date.

De La Rue Cash Systems, Brochure for MACH 12 Coin Sorter/Counter, 2 pages (1999).

De La Rue Cash Systems, Brochure for MACH 12HD Coin Sorter/Counter, 2 pages, no date.

Glory, Brochure for GSA-500 Sortmaster, 2 pages, no date.

Magner, Brochure for COINSTREAM™ CPS 502 Self-Service Coin Processing System, 2 pages, no date.

Magner, Brochure for MAG II 100 Series Coin Sorters, 2 pages, no date.

Magner, Brochure for MAG II Model 915 Coin Counter/Packager, 2 pages, no date.

Magner, Brochure for Pelican 305 Coin Sorter, 2 pages, no date.

Magner, Brochure for 900 Series Coin Counters and Packagers, 2 pages, no date.

PCT International Search Report dated Dec. 16, 2003 for International Application No. PCT/US03/18345, (3 pages).

* cited by examiner

FOREIGN OBJECT REMOVAL SYSTEM FOR A COIN PROCESSING DEVICE

CROSS-REFERENCE TO RELATED APPLICATIONS

This application is a continuation-in-part of U.S. patent application Ser. No. 10/459,649, filed Jun. 11, 2003, which claims priority to U.S. Provisional Patent Application Ser. No. 60/388,843, filed on Jun. 14, 2002, each of which is hereby incorporated by reference in its entirety.

FIELD OF THE INVENTION

The present invention relates generally to coin processing devices and, more particularly, to a self-service coin processing device having a gravity feed coin input tray and a system for detecting foreign objects input to the coin processing machine.

BACKGROUND OF THE INVENTION

Coin processing machines generally have the ability to receive bulk coins from a user of the machine. Coin processing machines include a redemption type of machine wherein, after the deposited coins are counted, a receipt is issued indicating the value of the deposited coins. The user may redeem this receipt for the amount of deposited coins in the form of banknotes. In other embodiments, the receipt is redeemed for the amount of the deposited coins less a commission charged for use of the coin redemption machine.

These self-service prior art coin redemption machines are commonly used in a banking environment and a retail environment such as a grocery store. In operation, a user inputs (i.e., deposits) a batch of coins of mixed denominations into a hopper of the coin redemption machine. The machine determines the value of the deposited coins and outputs a receipt indicative of the determined amount. In some embodiments, the receipt also indicates a second, lesser amount, which reflects a commission charged for use of the machine. The user redeems the receipt for paper currency for the value of the deposited coins less the commission. For example, in a banking environment, a user redeems the receipt at the teller's window. In a retail environment, the user can redeem the receipt at a cashier's station or a customer-service station.

A problem associated with coin redemption machines is that they are self-service in nature—a customer of a grocery store, for example, deposits that customer's coins into the machine. The self-service nature of the machine lends itself to foreign objects being deposited with the coins more frequently than in the situation where the machine is operated by an experienced and trained operator. Prior art coin redemption machines have focused on removing foreign objects that are included with the coins by providing perforated surfaces for sifting out the foreign objects and draining liquids from the coins, magnets for attracting ferric foreign objects, and fans for moving air over the coins to blow out light foreign objects.

These cleaning measures, however, have focused on removing foreign objects prior to the objects being input into the coin processing mechanism (e.g., a disk-type coin sorter) of the redemption machine and have not addressed the situation where foreign objects have bypassed these cleaning measures and are input to the coin processing mechanism. Examples of foreign objects include rings, watches, nuts, bolts, and washers as well as damaged or bent coins and tokens. Failure to remove these objects can cause damage to both the objects and to the coin processing mechanism. Thus, there exists a need for a coin redemption machine that can detect the presence and provide for the removal of foreign objects input to the coin processing device of the coin redemption machine.

SUMMARY OF THE INVENTION

A coin processing system includes a coin input area for receiving coins from a user, and a coin processing module for receiving and counting the coins from the coin input area. The coin processing module includes a coin hopper, a coin processing area, and a foreign object removal system. The coin hopper receives the coins from the coin input area. The coin processing area receives and counts the coins from the coin hopper. The foreign object removal system is located at least partially within the coin hopper, and removes a foreign object from the coin hopper subsequent to receiving the foreign object from the coin input area.

In another aspect of the present invention, a coin processing system includes a coin input area, a coin hopper, a rotatable disk, a sorting head, and a debris removal system. The coin input area receives a plurality of coins from a user, and the coin hopper receives the plurality of coins from the coin input area. The rotatable disk includes a resilient pad for imparting motion to the plurality of coins in the coin hopper. The sorting head has a lower surface generally parallel to and spaced slightly from the resilient upper surface of the disk. The lower surface of the sorting head forms a plurality of coin exit channels for sorting and discharging coins of different denominations. The debris removal system removes debris from the coin hopper.

In an alternative aspect of the present invention, a method for removing foreign objects in a coin processing system includes providing a plurality of coins in a coin input area of the coin processing system. The method includes receiving the coins from the coin input area in a coin hopper of a coin processing module. The method further includes counting the coins from the coin hopper in a coin processing area of the coin processing module. The method also includes removing a foreign object from the coin hopper subsequent to receiving the foreign object from the coin input area.

In another alternative aspect of the present invention, a method for removing debris in a coin processing system includes receiving a plurality of coins in a coin hopper of a coin processing module. The coins are received from a coin input area of the coin processing system. A rotatable disk of the coin processing module imparts motion to the coins in the coin hopper. The coins are sorted according to coin denomination using a plurality of coin exit channels. The method further includes removing debris from the coin hopper after the coins have been counted.

The above summary of the present invention is not intended to represent each embodiment, or every aspect, of the present invention. Additional features and benefits of the present invention will become apparent from the detailed description, figures, and embodiments set forth below.

Figure 1:
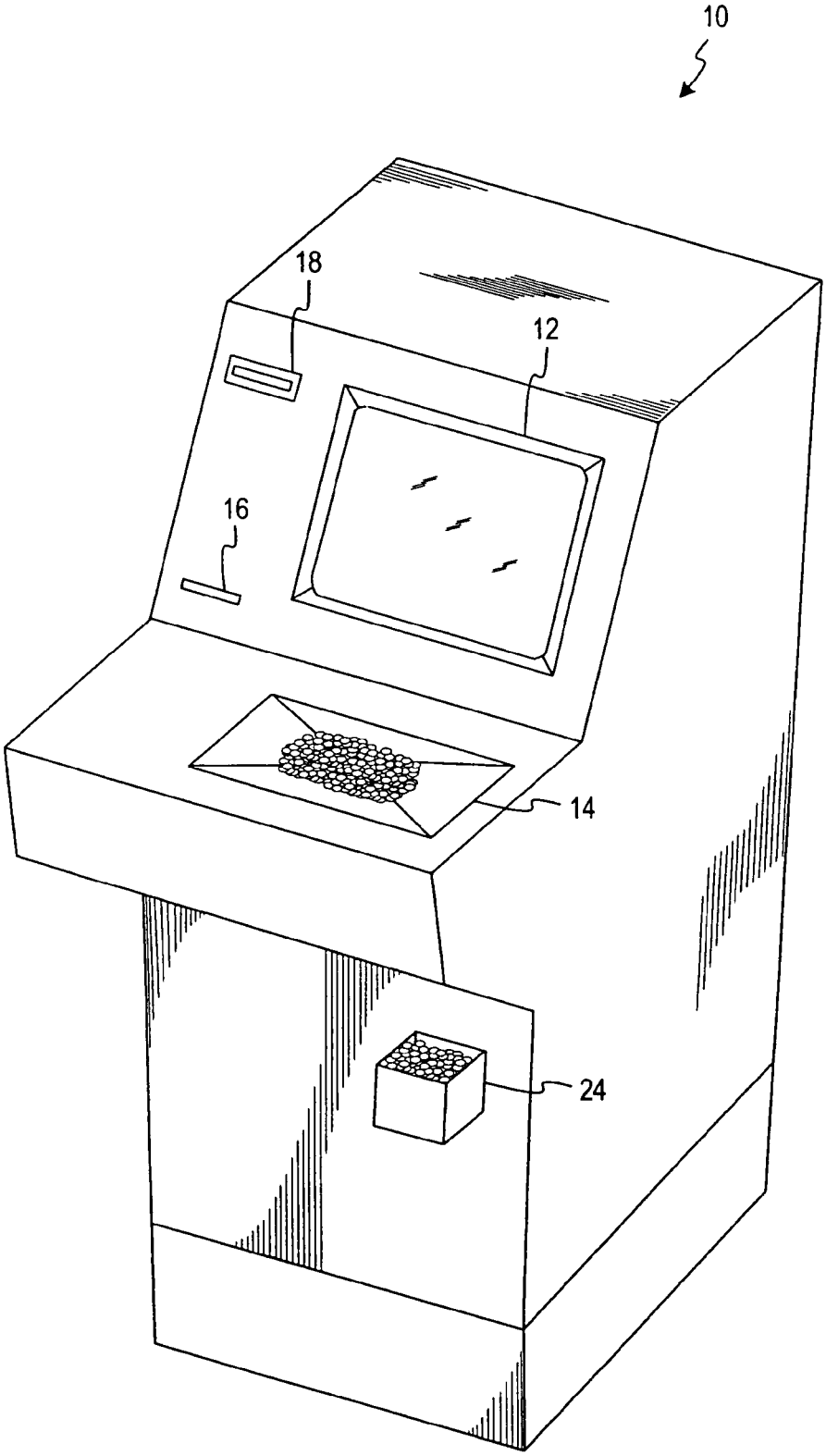
FIG. 1 is a perspective view of a coin redemption machine according to one embodiment of the present invention.

While the invention is susceptible to various modifications and alternative forms, specific embodiments will be shown by way of example in the drawings and will be desired in detail herein. It should be understood, however, that the invention is not intended to be limited to the particular forms disclosed.

DETAILED DESCRIPTION OF THE ILLUSTRATED EMBODIMENTS

Referring to the drawings and initially to FIG. 1, a coin redemption machine 10 according to one embodiment of the present invention includes a touch screen 12 to provide inputs from a machine user and also to display outputs to be viewed by the user. While a touch screen 12 is illustrated in FIG. 1 for receiving data entered by a user of the coin redemption machine 10, the coin redemption machine 10 may also include a mechanical keyboard or buttons to receive such inputs.

The coin redemption machine 10 includes a coin input area 14 which receives coins of mixed denominations from a user. The coin input area 14 allows the user of the currency processing machine 10 to deposit the user's coins which will ultimately be converted to some other sort of fund source (i.e., banknotes, credit to a smartcard, credit to an account, credit for purchases in the store containing the redemption machine 10, etc.) that is available to the user.

According to the embodiment of the coin redemption machine 10 illustrated in FIG. 1, the coin input area 14 is generally funnel-shaped to direct coins to a coin processing area within the machine 10. According to another alternative embodiment, the coin input area 14 includes a gravity-feed coin input tray as is discussed in further detail below. According to still another alternative embodiment of the coin redemption machine 10, the coin input area 14 includes a coin tray that is pivotable from a first position, wherein the coin tray is substantially horizontal, to a second position, wherein the coin tray is lifted causing the coins to slide under the force of gravity into the coin redemption machine 10.

In its simplest form, the coin redemption machine 10 receives coins via the coin input receptacle 14, and after these deposited coins have been authenticated and counted, the currency redemption machine 10 outputs a receipt to the user indicative of the dollar amount of the deposited coins. The currency processing machine 10 includes a paper dispensing slot 16 for providing a user with the receipt of the transaction that the user has performed. For example, the user of the currency processing machine 10 may input $20.50 in various coins and the coin redemption machine 10 prints a receipt indicating that $20.50 worth of coins have been processed. The user can redeem the receipt for funds from an attendant of the coin redemption machine 10. An attendant may include a store employee such as a cashier at a grocery store or a teller at a bank. Alternatively, the user can redeem the receipt for credit towards purchases at the store where the machine is located. Alternatively still, the currency processing machine 10 credits a user's account such as a bank account or an account associated with a store credit cards, a store "rewards" program card or a coupon-type card which a user produces at the time of purchase for discounts. Further, in other embodiments, a commission may be charged for use of the machine. Additionally, in other alternative embodiments of the coin redemption machine 10, the receipt includes other information such as a transaction number, totals for each coin denomination, date, time, store location, and a commission amount (if any) charged for use of the machine.

The coin redemption machine 10 also includes a media slot 18 into which the user may insert an account card (e.g., a bank card such as an ATM card, an identification card including the type distributed by grocery stores, smartcards, etc.). The media slot is coupled to a media reader/writer device 34 (FIG. 2) in the coin redemption machine 10 that is capable of reading from or writing to one or more types of media including ATM cards, credit cards, smartcards or other types of media cards. This media may include various types of memory storage technology such as magnetic storage, solid state memory devices, and optical devices. The touch screen 12 typically provides the user with a menu of options which prompts the user to carry out a series of actions for identifying the user by displaying certain commands and requesting that the user depress touch keys on the touch screen 12 (e.g., a user PIN, account number, etc.).

Figure 2:
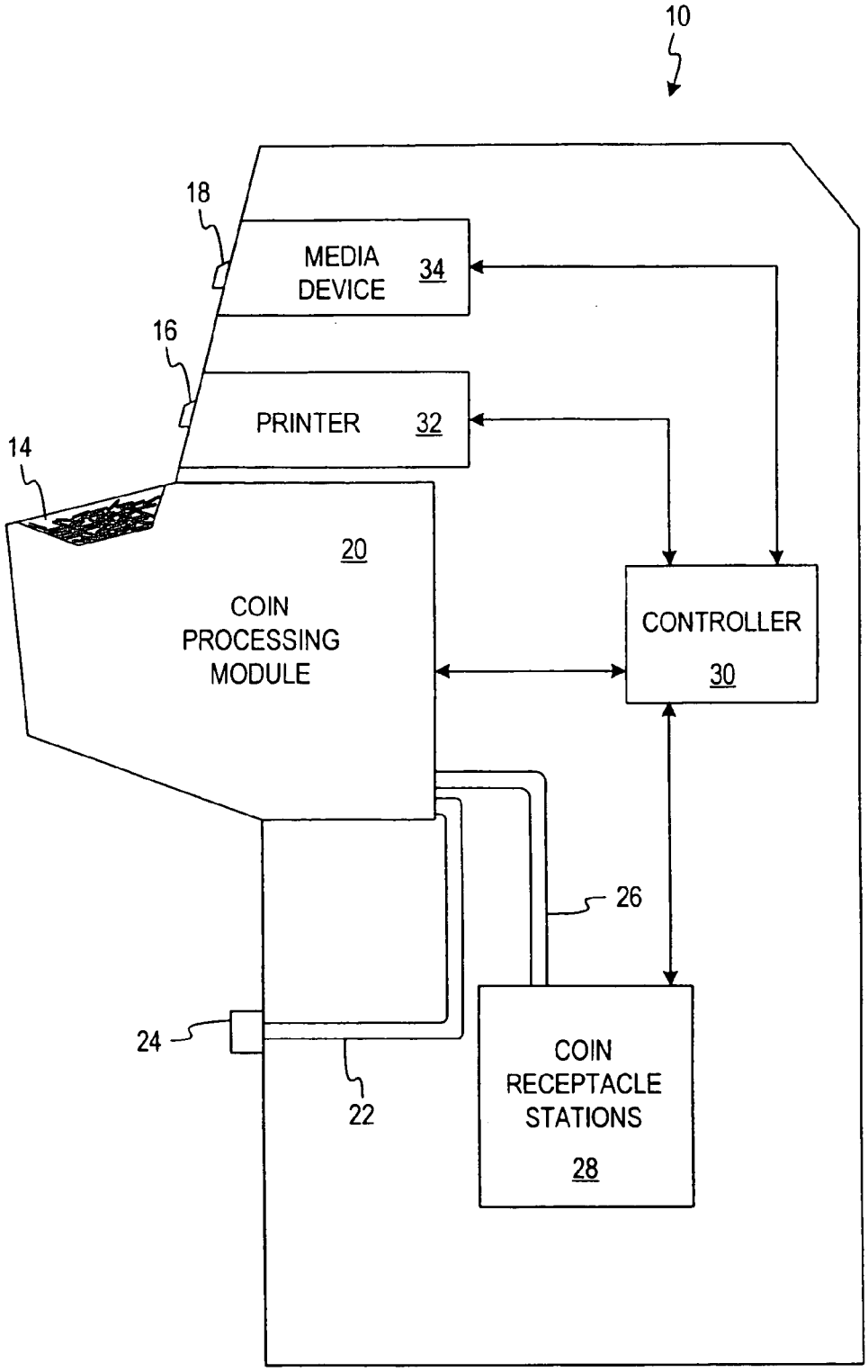
FIG. 2 is a side view of the coin redemption machine shown in FIG. 1 which schematically illustrates the components present in the coin redemption machine according to one embodiment of the present invention.

FIG. 2 illustrates a side view of the coin redemption machine 10. The coin redemption machine 10 includes a coin processing module 20. The coin processing module 20 counts and authenticates coins of mixed denominations that are deposited in the coin input receptacle 14, which leads directly into the coin processing module 20. The coins may also be sorted in the coin processing module 20 in a variety of ways such as by sorting based on the diameter of the coins. When a coin can not be authenticated by the coin processing module 20, that coin is directed through a coin reject tube 22 to the rejected coin receptacle 24 which allows the user who deposited such a non-authenticated coin to retrieve the coin by accessing the dispensed coin receptacle 24. Alternatively, non-authenticated coins may be routed to a reject coin bin (not shown) disposed within the coin redemption machine 10 and are not returned to the user. Disk-type coin sorters and authenticating devices which can perform the function of the coin processing module 20 of the coin redemption machine 10 are disclosed in U.S. Pat. No. 5,299,977 (entitled "Coin Handling System"); U.S. Pat. No. 5,453,047 (entitled "Coin Handling System"); U.S. Pat. No. 5,507,379 (entitled "Coin Handling System with Coin Sensor Discriminator"); U.S. Pat. No. 5,542,880 ("Coin Handling System with Shunting Mechanism"); U.S. Pat. No. 5,865,673 (entitled "Coin Sorter"); and U.S. Pat. No. 5,997,395 (entitled "High Speed Coin Sorter Having a Reduced Size"); each of which is incorporated herein by reference in its entirety.

Alternatively, other coins sorters such as rail sorters can be used to perform the function of the coin processing module 20. A rail sorter that can perform the function of the coin processing module 20 of the coin redemption machine 10 according to an alternative embodiment of the present invention is described in U.S. Pat. No. 5,382,191 (entitled "Coin Queuing Device and Power Rail Sorter"), which is incorporated herein by reference in its entirety.

The coin processing module 20 outputs the authenticated coins via one or more exit channels (not shown). According to one embodiment, each coin exit channel is coupled to a coin tube 26 which is coupled to a coin receptacle station 28. The coin tubes 26 lead to coin receptacle stations (or bins) 28 for each of the coin denominations that are to be sorted and authenticated by the coin processing module 20. The coin receptacle station 28 includes coin bags or bins for holding each sorted coin denomination. Other coin distribution schemes are implemented in alternative embodiments of the present invention. Many alternative coin distribution schemes are described in greater detail in U.S. Pat. No. 6,318,537 entitled "Currency Processing Machine with Multiple Internal Coin Receptacles," which is incorporated herein by reference in its entirety.

The currency processing machine 10 includes a controller 30 which is coupled to the coin processing module 20, a printer 32 for outputting a receipt via the paper dispensing slot 16, and a media reader/writer device 34 for receiving media via the media slot 18 within the currency processing machine 10 and controls the interaction among these units. For example, the controller 30 may review the inputs totals from the coin processing module 20 and direct the printer 32 to output a receipt indicative of the total amount or direct the media reader/writer device 34 to credit a smartcard the values of the processed coins.

In an alternative embodiment of the coin redemption machine 10, the coin processing module 20 only counts the coins and does not store the coins in a sorted fashion. Or, the coin processing module 20 may tabulate the value of the coins that are processed without ever sorting them. In either of these situations, the coins are sent from the coin processing module 20 to a single coin receptacle station 28 as mixed coins. Because the coins are not being sorted by denomination, the coin redemption machine 10 only requires one receptacle station 28 for collecting all of the mixed coins.

Figure 3:
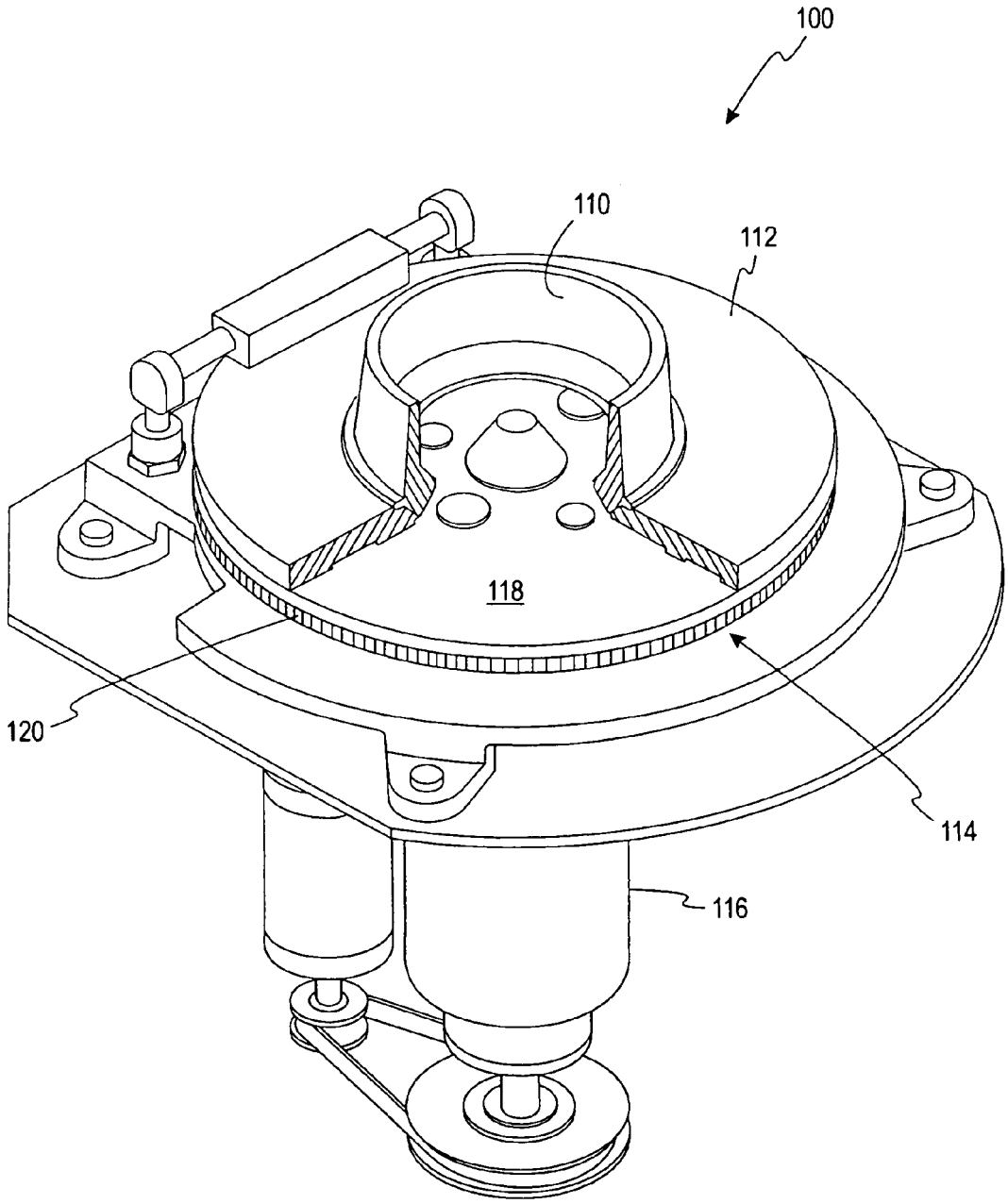
FIG. 3 is a perspective view of a coin processing system for use with the coin redemption machine of FIG. 1, according to one embodiment of the present invention, with portions thereof broken away to show the internal structure.

Referring now to FIG. 3, a disk-type coin processing system 100 is shown which can be used as the coin processing module 20 of FIG. 2 according to one embodiment of the present invention. The coin processing system 100 includes a hopper 110 for receiving coins of mixed denominations that feeds the coins through a central opening in an annular sorting head 112. As the coins pass through this opening, they are deposited on the top surface of a rotatable disk 114. This rotatable disk 114 is mounted for rotation on a shaft (not shown) and is driven by an electric motor 116. The disk 114 typically comprises a resilient pad 118, preferably made of a resilient rubber or polymeric material, bonded to the top surface of a solid disk 120. While the solid disk 120 is often made of metal, it can also be made of a rigid polymeric material.

According to one embodiment, coins are initially deposited by a user in a gravity-feed coin tray (FIGS. 8*a*-10) disposed above the coin processing system 100 (FIG. 1). Coin flow through an aperture in the gravity-feed coin tray which funnels the coins into the hopper 110. Alternatively, a pivoting coin tray can be used in other embodiments of the present invention. The user lifts the pivoting coin tray which funnels the coins into the hopper 110. A pivoting coin tray suitable for use in connection with the coin processing system 100 is described in detail in U.S. Pat. No. 4,964,495 (entitled "Pivoting Tray for Coin Sorter"), which is incorporated herein by reference in its entirety.

As the disk 114 is rotated, the coins deposited on the resilient pad 118 tend to slide outwardly over the surface of the pad 118 due to centrifugal force. As the coins move outwardly, those coins that are lying flat on the pad 118 enter the gap between the surface of the pad 118 and the sorting head 112 because the underside of the inner periphery of the sorting head 112 is spaced above the pad 118 by a distance which is about the same as the thickness of the thickest coin. As is further described below, the coins are processed and sent to exit stations where they are discharged. The coin exit stations may sort the coins into their respective denominations and discharge the coins from exit channels in the sorting head 112 corresponding to their denominations.

Figure 4:
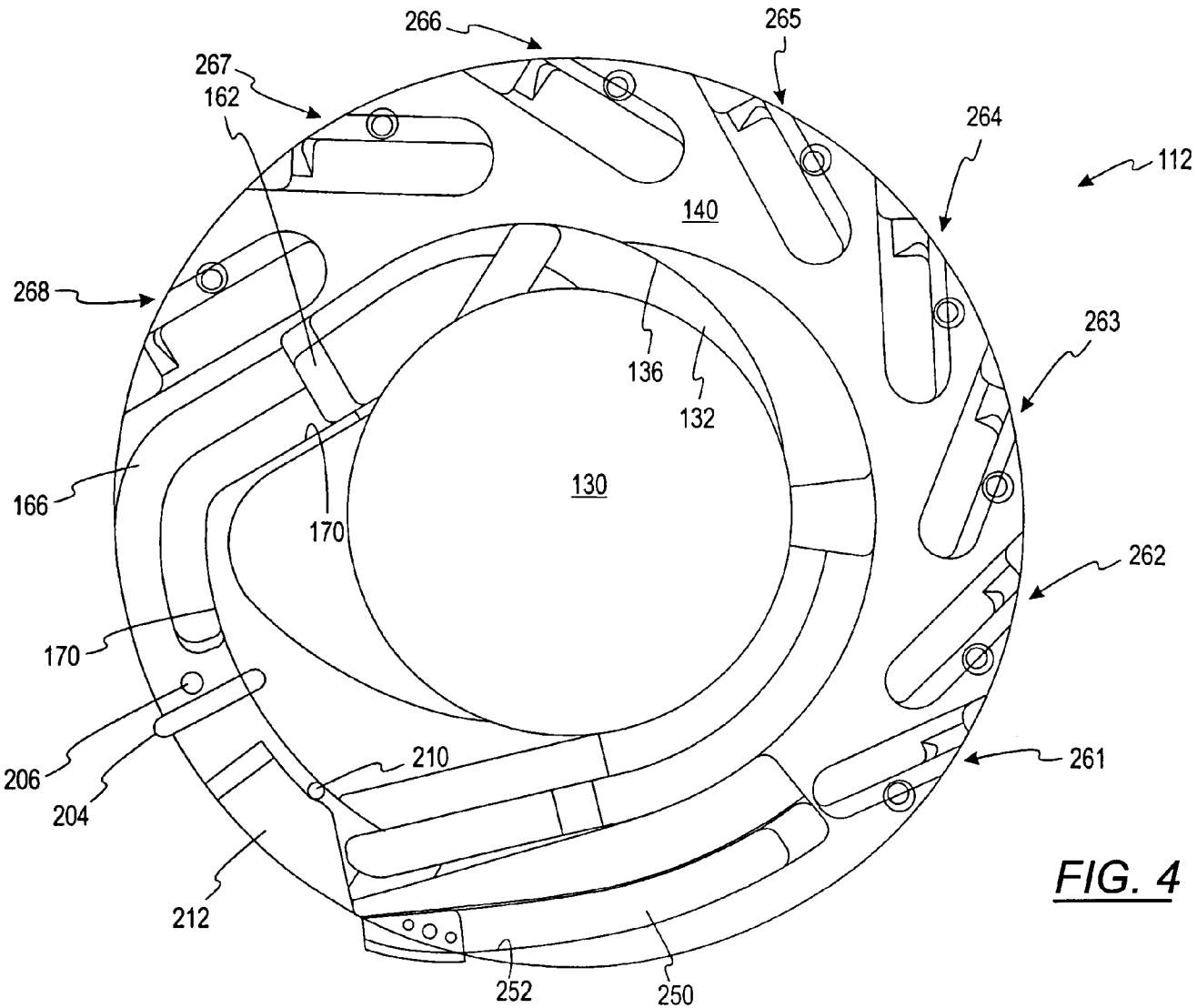
FIG. 4 is an enlarged bottom view of a sorting head for use with the coin processing system of FIG. 3 according to one embodiment of the present invention.

Referring now to FIG. 4, the underside of the sorting head 112 is shown. The coin sets for any given country are sorted by the sorting head 112 due to variations in the diameter size. The coins circulate between the sorting head 112 and the rotating pad 118 (FIG. 1) on the rotatable disk 114 (FIG. 1). The coins are deposited on the pad 118 via a central opening 130 and initially enter the entry channel 132 formed in the underside of the sorting head 112. It should be keep in mind that the circulation of the coins in FIG. 4 appears counterclockwise because FIG. 2 is a view of the underside of the sorting head 112.

An outer wall 136 of the entry channel 132 divides the entry channel 132 from the lowermost surface 140 of the sorting head 112. The lowermost surface 140 is preferably spaced from the pad 118 by a distance that is slightly less than the thickness of the thinnest coins. Consequently, the initial outward radial movement of all the coins is terminated when the coin engage the outer wall 136, although the coins continue to move more circumferentially along the wall 136 (in the counterclockwise directed as viewed in FIG. 2) by the rotational movement imparted to the coins by the pad 118 of the rotatable disk 114.

As the pad 118 continues to rotate, those coins that were initially aligned along the wall 136 move across the ramp 162 leading to the queuing channel 166 for aligning the innermost edge of each coin along an inner queuing wall 170. The coins are gripped between the queuing channel 166 and the pad 118 as the coins are rotated through the queuing channel 166. The coins, which were initially aligned with the outer wall 136 of the entry channel 130 as the coins move across the ramp 162 and into the queuing channel 166, are rotated into engagement with inner queuing wall 170. As the pad 118 continues to rotate, the coins which are being positively driven by the pad move through the queuing channel 166 along the queuing wall 170 passed a trigger sensor 206 and a discrimination sensor 204 for discriminating between valid and invalid coins. In other embodiments, the discrimination sensor also determines the denomination of the coins. The trigger sensors 206 sends a signal to the discrimination sensor 204 that a coin is approaching.

Coins determined to be invalid are rejected by a diverting pin 210 which is lowered and impacts an invalid coin to redirect the invalid coin to the reject channel 212 that guides the rejected coins to a reject chute 22 (FIG. 2), which directs the coin back to the user. The diverting pin 210 remains in its home, or nondiverting position, until an invalid coin is detected. Those coins not diverted into the reject channel 212 continue along inner queuing wall 170 to the gauging region 250. The inner queuing wall 170 terminates just downstream of the reject channel 212; thus, the coins no longer abut the inner queuing wall 170 at this point and the queuing channel 166 terminates. The radial position of the coins is maintained, because the coins remain under pad pressure, until the coins contact an outer wall 252 of the gauging region 250.

The gauging wall 252 aligns the coins along a common radius as the coins approach a series of coin exit channels 261-268 that discharge coins of different denominations. The first exit channel 261 is dedicated to the smallest coin to be sorted (e.g., the dime in the U.S. coin set). Beyond the first exit channel 261, the sorting head 112 shown in FIG. 2 forms seven more exit channels 261-268 which discharge coins of different denominations at different circumferential locations around the periphery of the sorting head 112. Thus, the exit channels 261-268 are spaced circumferentially around the outer periphery of the sorting head 112 with the innermost edges of successive channels located progressively closer to the center of the sorting head 112 so that coins are discharged in the order of decreasing diameter. The number of exit channels can vary according to alternative embodiments of the present invention.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 118. To maintain a constant radial position of the coins, the pad 118 continues to exert pressure on the coins as they move between successive exit channels 261-268.

Further details of the operation of the sorting head 112 shown in FIG. 4 are disclosed in U.S. patent application Ser. No. 10/095,164 (entitled "Disk-Type Coin Processing Device Having Improved Coin Discrimination System"), which was filed on Mar. 11, 2002 and is incorporated herein by reference in its entirety.

As discussed above in the Background Section, foreign non-coin objects can be input to the coin redemption machine. Where the foreign object has a coin-like shape, the object can be detected and rejected as described in connection with an invalid coin. Examples of such objects can include foreign coins, some damaged coins, and washers. In other situations, the foreign objects become caught between the pad 118 and the sorting head 112 and continue to rotate around the sorting head in pressed contact with the pad 118. Bent coins are an example of foreign objects that become caught between the pad 118 and the sorting head 112. Another class of foreign objects are those that are too large to fit between the pad 118 and the sorting head 112. These larger foreign objects remain on the pad 118 in the space defined by the central opening 130 of the sorting head 112 and bounce off of the hopper 110 as the pad 118 rotates. It is desirable to remove foreign objects from the coin processing system 100 to avoid damage to the system 100. For example, some foreign objects can cut, tear, or otherwise damage the resilient pad 118. Other foreign objects, particularly those caught between the pad 118 and the sorting head 112 can also abrasively wear against the sorting head 112 in addition to damaging the pad 118.

Figure 5:
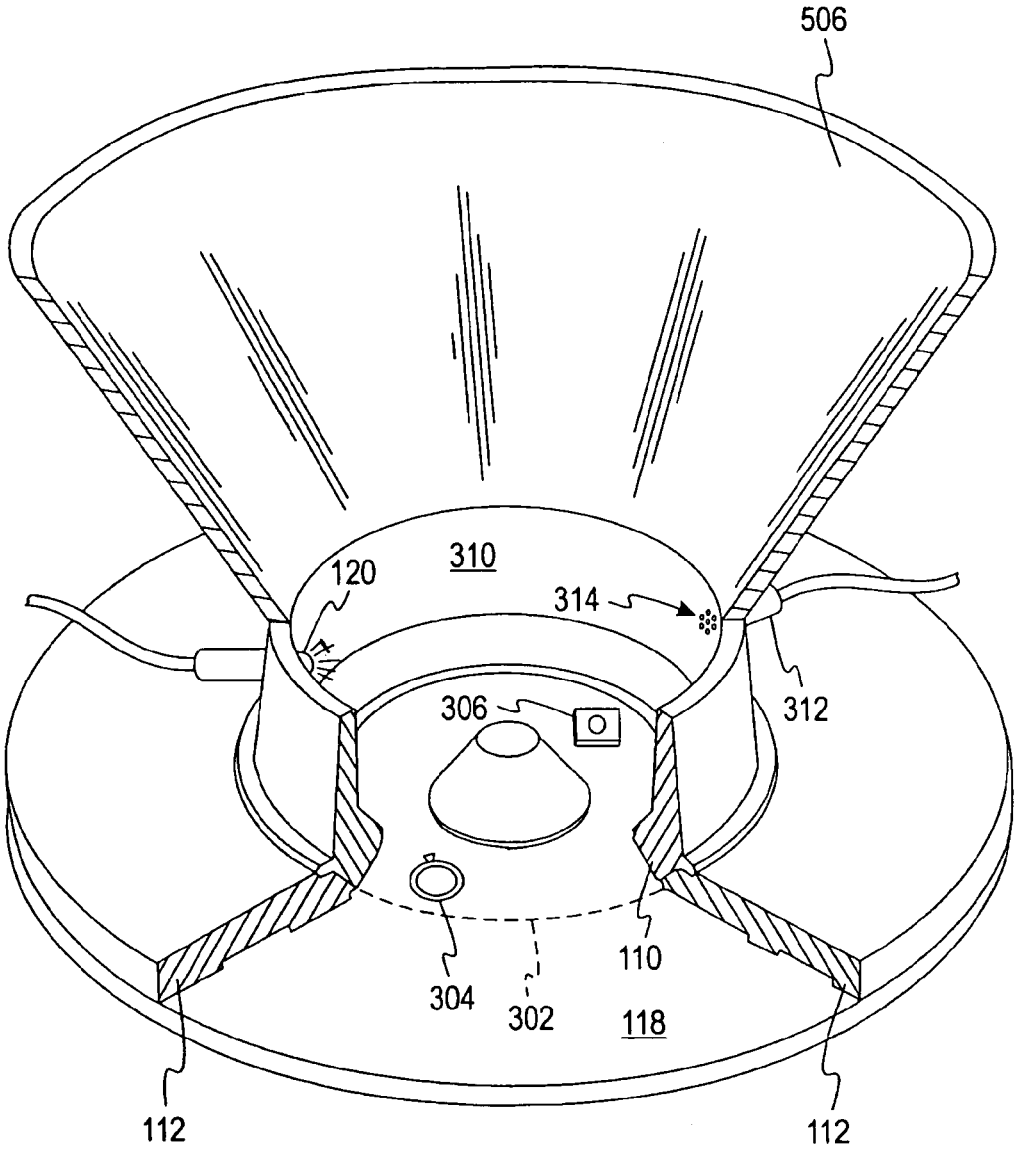
FIG. 5 is an enlarged sectional view of a coin input area of the coin processing system of FIG. 3.

Referring now to FIG. 5, a cross-sectional view of the coin hopper 110 and sorting head 112 is shown disposed above the rotatable pad 118. In FIG. 5, a portion of a bowl-like portion 506 of a gravity-feed coin input tray 500, which is discussed in connection with FIGS. 8*a*-13*b*, is shown for funneling deposited coins into the hopper 110. A dashed-line 302 is shown representing the area of the pad 118 bound by the central opening 130 (FIG. 4) of the sorting head 112. Two foreign objects—a ring 304 and a bolt 306—are shown disposed on the rotating pad 118 in the area of the pad 118 bound by the central opening 130. In operation of the coin processing system 100, the coins deposited on the pad 118 are sorted as described above. After all the coins have been sorted, inputted foreign objects such as the ring 304 and bolt 306 may remain on the pad 118 as shown. These objects continue to rotate about the pad 118 and contact (e.g., bounce off of) the interior wall 310 of the hopper 110. This contact with the interior wall 310 of the hopper 110 creates a detectable amount of sound. While this sound may be unnoticeable while a plurality of coins remain on the pad 118 and are being processed, the foreign object sound is detectable after substantially all the coins have been processed and only a few coins, if any, remain on the pad 118. It is the sound of the foreign objects repeatedly slamming into and bouncing off the interior wall 310 of the hopper 110, the scrapping sound of coins caught between the pad 118 and the sorting head 112, the sound created by foreign objects contacting each other, or a combination thereof that is used to detect whether a foreign object remains in the coin processing system 100 after the coins have been processed.

According to one embodiment of the present invention, the coin processing system 100 includes a microphone 312 mounted within the hopper 110. Other embodiments of the present invention include a plurality of microphones 312 disposed around the hopper 110. The microphone 312 is mounted flush with the interior wall 310 of the hopper 110 so the microphone 312 does not impact or disrupt the coins funneled into the hopper 110. Alternatively, the hopper 110 includes a plurality of small apertures 314 that transmit the sound from inside the hopper 110 to the microphone 312. A microphone suitable for use with one embodiment of the present invention is manufactured by Panasonic, Model No. WM-56 A103.

Figure 6:
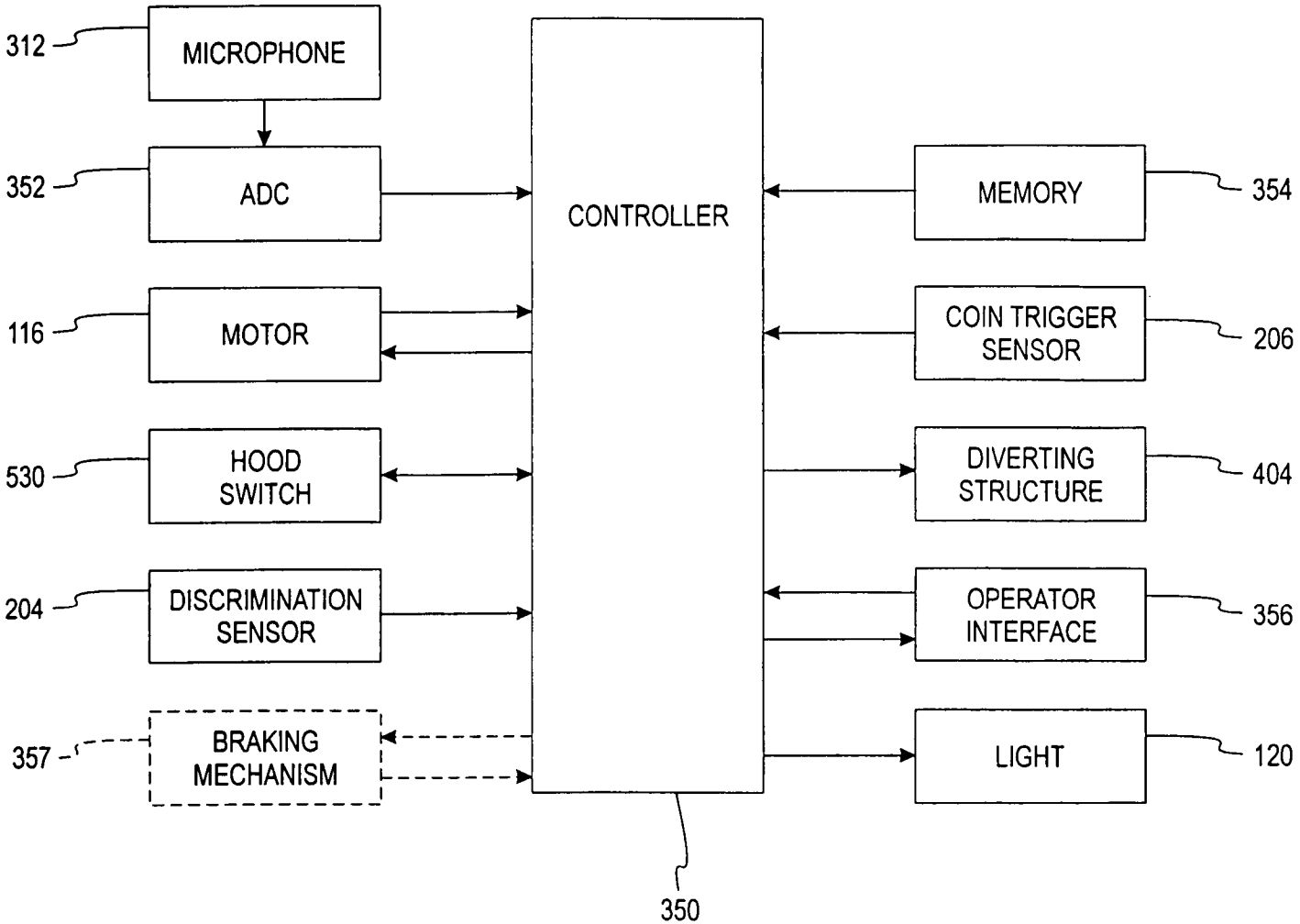
FIG. 6 is a functional block diagram of the control system for the coin redemption machine shown in FIG. 1.

Referring now to FIG. 6, a controller 350 for controlling the operation of the coin processing system 100 is shown according to one embodiment of the present invention. The microphone 312 is used in the detection of foreign objects rotating on the pad 118. The controller 350 determines that substantially all the coins have been processed when coins no longer travel past the coin discrimination sensor 204, the coin trigger sensor 206, or another coin sensor after a predetermined time period (e.g. five to ten seconds). Once the controller 350 determines that there are no more coins to be processed, the controller 350 begins monitoring the sound level within the hopper 110 of the coin processing system 100.

The microphone 312 detects the sound level inside the hopper 110 and generates an analog signal indicative thereof. That analog audio signal is transmitted to an analog-to-digital converter (ADC) 352 coupled to the microphone 312. The ADC 352 inputs the digitized audio signal to the controller 350. The controller 350, which can optionally be located in a personal computer (e.g., a pc), then compares the audio signal to master ambient sound level data stored in a memory 354 of the coin processing system 100. The stored master ambient sound level data has been previously obtained via the microphone 312 when no coins or foreign objects are disposed on the pad 118 according to one embodiment of the present invention. If the audio signal generated by the microphone 312 is within a predetermined threshold of the stored master ambient sound data, the controller 350 determines that no foreign object is present within the hopper 110 and the coin processing system 100 proceeds as normal. If the audio signal generated by the microphone 312 exceeds the master ambient sound level data stored in the memory 354 by a predetermined threshold, the controller 350 determines that a foreign object is rotating on the pad 118. Put another way, the controller 350 detects the presence of a foreign object if the detected sound level is above a predetermined sound floor.

In response to the detected foreign object, the controller 350 generates a foreign object detection signal that is communicated to the user of the machine via an user display or operator interface 356. Once the pad 118 stops rotating and the operator interface 356 indicates such, the user can retrieve the foreign object from the pad 118 as is described in further detail below. The coin processing system 100 may include a light 120 (FIG. 5) for illuminating the area inside the hopper 110 to facilitate the user's retrieval of the foreign object according to an alternative embodiment of the present invention. Optionally, the light 120 may be a warning and/or incident notification light.

According to one embodiment of the present invention, the microphone 312 is manufactured by Panasonic, Model No. WM-56A103, and outputs a voltage proportional to the detected sound level inside the hopper 110. Table I shows the peak voltage levels output by the microphone 312 in response to three exemplary foreign objects on the pad 118 and within the hopper 110 as well as the ambient sound level (mostly caused by the motor) and the threshold above-which a foreign object is considered to be present according to one embodiment of the present invention. The threshold can be varied in alternative embodiments of the present invention. It may be necessary to vary the threshold in situations where the ambient sound level varies from different motors, different environments, etc. The digitized voltage output by the microphone 312 was measured by a Tektronix TDS-210 digital oscilloscope.

TABLE I

| Ambient Level | Foreign Object Threshold | Small Plastic Object | Candy | Wood Block |
|---|---|---|---|---|
| 1.46 volts | 1.76 volts | 1.88 Volts | 3.08 volts | 3.22 volts |

The small plastic piece was a LEGO® having dimensions of about 0.5 inch×0.25 inch×0.5 inch, the piece of candy test was a cough drop in its wrapper having dimensions of about 1 inch×0.5 inch×0.5 inch, and the wood block had dimensions of about 1.5 inch×1 inch×3/16 inch.

In alternative embodiments of the present invention, other foreign object detection systems are implemented. In one alternative embodiment, a plurality of light sources (e.g., light emitting diodes) and a plurality of light detectors (e.g., photodetectors, photodetector arrays, or charged coupled device (CCD) arrays) coupled to the controller 350 are used for detecting the presence of object on the pad 118 inside the hopper 110. Normally when no foreign object is present, the light sources emit light that is received by light detectors sensors. But when a disruption in the emitted light is introduced such as by a foreign object in the hopper 110, the light detectors will not receive the emitted light. The controller 350 detects a drop in the signal level generated by a light detector(s) and determines that a foreign object is present on the pad 118 in the hopper 110. In other alternative embodiments, the coin processing system 100 includes one or more motion sensors disposed in the hopper 110 for detecting the movement of foreign objects on the pad 118.

As discussed above, damaged or bent coins can become caught between the pad 118 and the sorting head 112. The bent coins, which are in pressed contact with the sorting head 112, continue to maintain their radial position on the pad 118. Put simply, the bent coins become caught and continue to rotate around the pad 118 underneath the sorting head 112. As bent coins rotate around the pad beneath the sorting head, they generate sound as they contact the various surfaces formed in the underside of the sorting head 112. This type of sound is also detectable and is used to detect the presence of foreign objects in a manner similar to that described above in connection with the foreign objects disposed on the pad 118 in the area defined by the central opening 130 of the sorting head 112.

Figure 7:
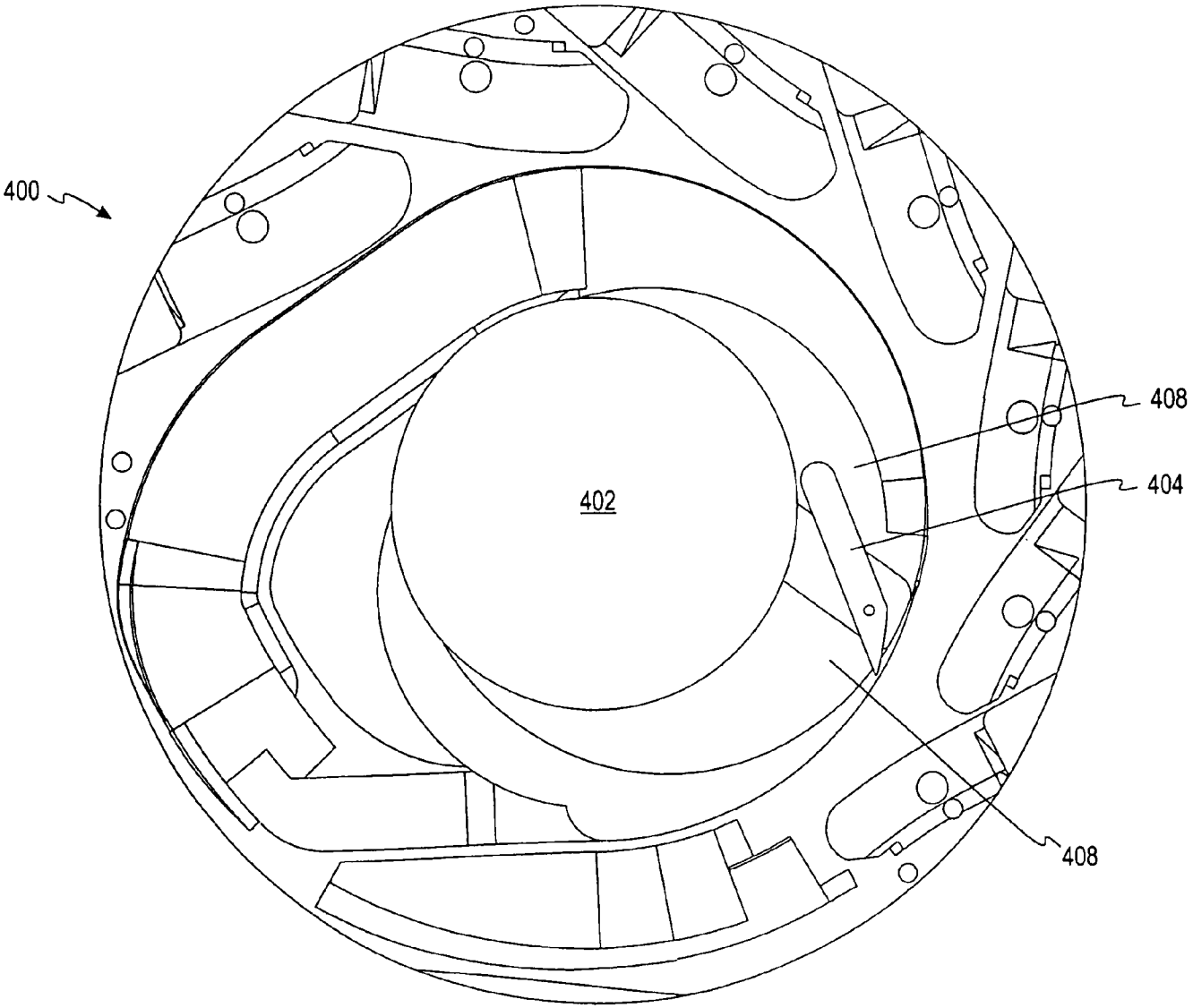
FIG. 7 is a bottom view of a sorting head having a diverting structure for use with the coin processing system of FIG. 3 according to an alternative embodiment of the present invention.
Figure 8A:
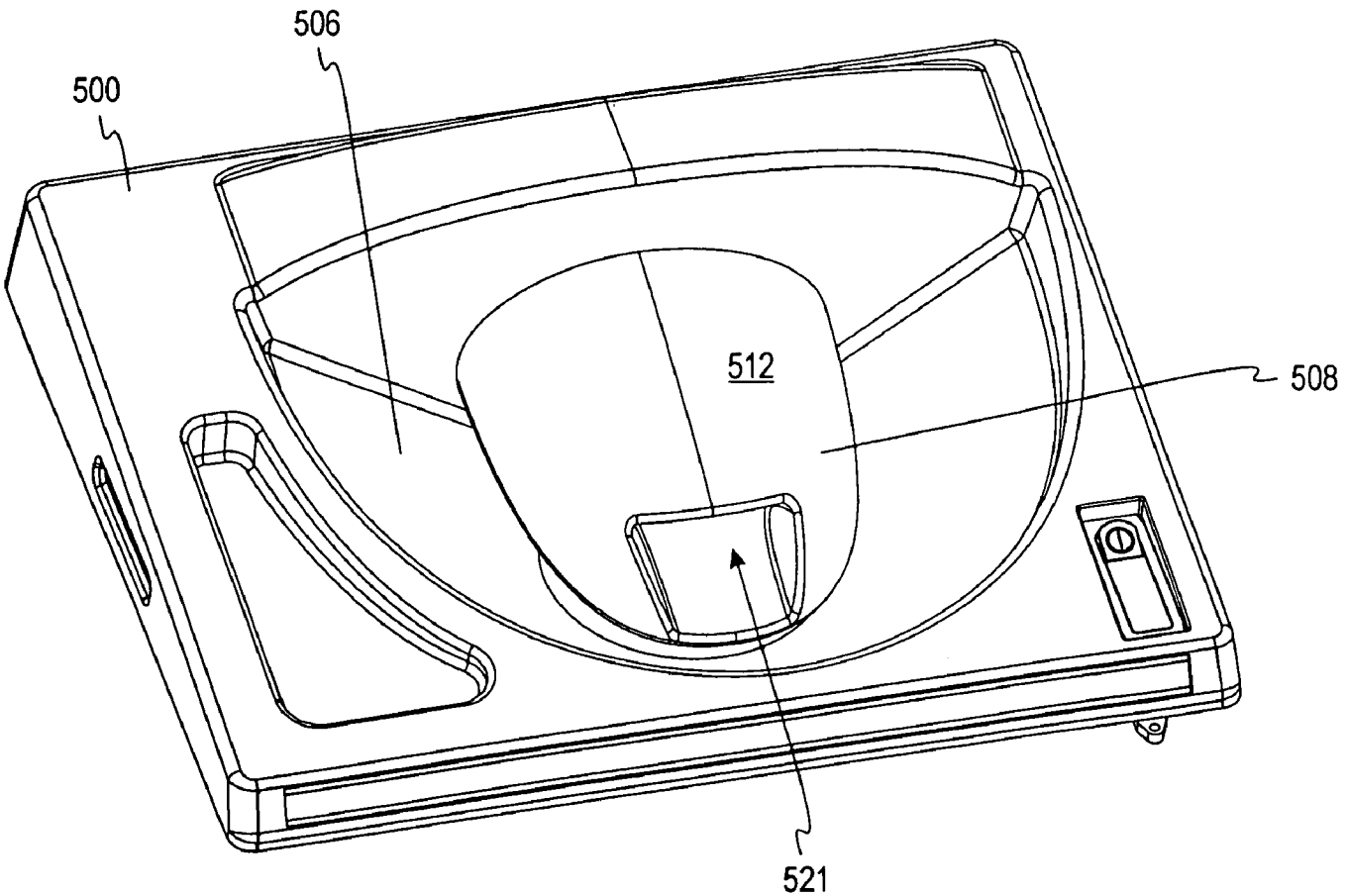
FIG. 8*a* is a perspective view of a gravity-feed coin input tray for use with the coin redemption machine of FIG. 1, with a hood shown in a lowered position, according to another embodiment of the present invention.
Figure 8B:
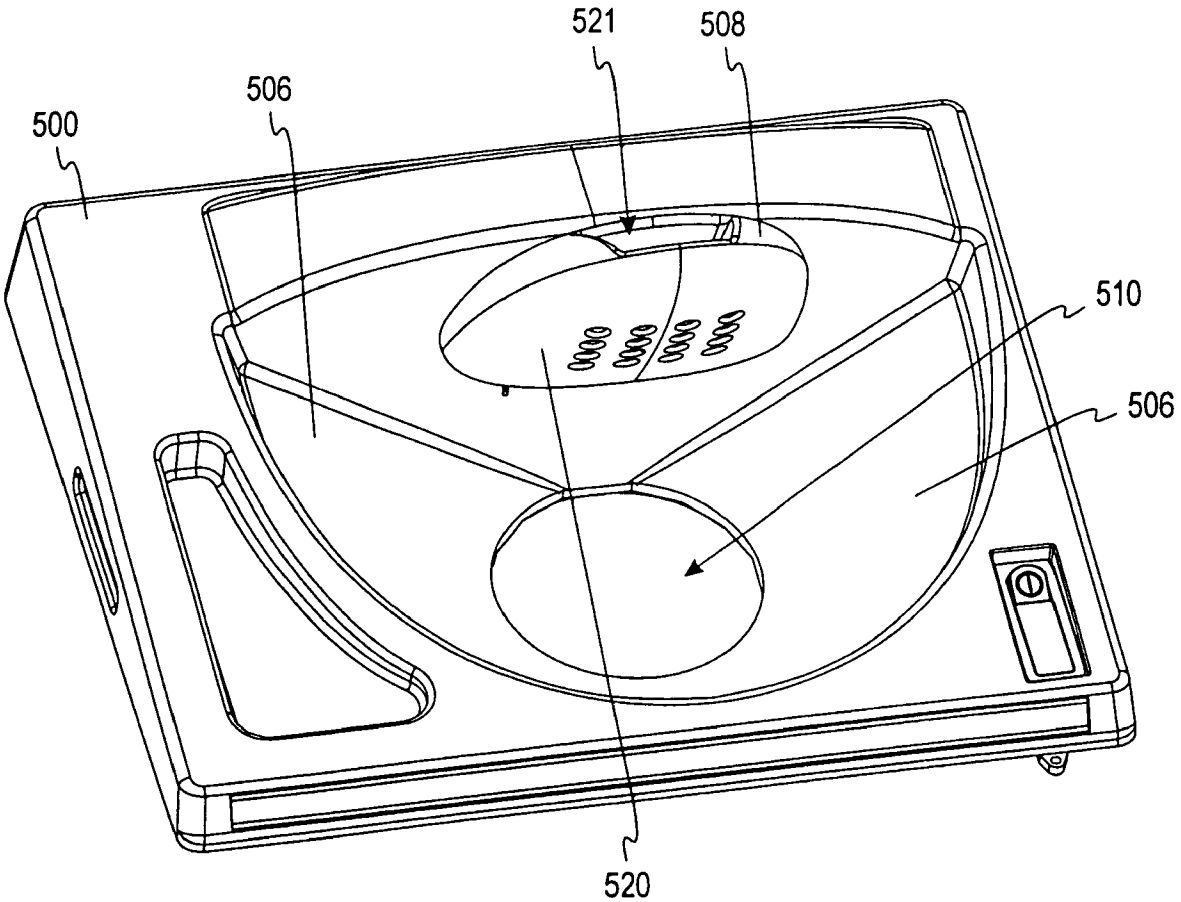
FIG. 8*b* is a perspective view of a gravity-feed coin input tray of FIG. 8*a* with the hood shown in a raised position.

Referring to FIG. 7, the underside of a sorting head 400 that can be used with the coin processing system 100 according to an alternative embodiment of the present invention. The sorting head 400 includes a diverting structure 404 that can be lowered towards the pad for directing objects such as bent coins back to the central opening 406 in the sorting head 400. Under normal operating conditions during the sorting of coins, the diverting structure 404 is retracted such that it is substantially flush with the adjacent surfaces 408 of the sorting head. However, when the controller 350 determines that a foreign object is present on the rotable pad (either between the pad 118 and sorting head 400 or within the central opening 402) the controller slows the speed of the rotating pad and lowers—viewed out of the page in FIG. 7—the diverting structure 404. The vertical moment of the diverting structure 404 can be provided by a solenoid, a voice coil, or a cam. Foreign objects caught between the pad 118 and the sorting head 112 contact the diverting structure 404 and are directed back to the area of the pad 118 bound by the central opening 402. The diverting structure 404 is angled toward the center of the pad 118 to decrease the radial position of the foreign objects as the objects are guided along the edge of the diverting structure 404. Put another way, the foreign objects, which are in pressed contact with the pad 118, are driven against the side of the diverting structure 404 and back towards the center of the pad 118.

According to one embodiment, the rotational speed of the pad 118 is lowered so that the foreign objects are not flung radially outward on the pad 118 due to the rotational movement of the pad 118 and back into the space between the pad 118 and the sorting head 112. Once the diverting structure 404 has been lowered and the foreign objects caught between the sorting head 112 and the pad 118 are directed back to the center of the pad 118, the controller 350 stops the rotation of the pad 118 and the user can retrieve the foreign objects from the pad 118. The diverting structure 404 then returns to its retracted position-viewed into the page in FIG. 7.

According to an alternative embodiment, the diverting structure 404 remains lowered and the pad 118 continues to rotates at a very slow speed while the user retrieves the foreign objects from the pad 118 to continually purge the space between the pad 118 and sorting head 400 of foreign objects that may become re-caught in that space. This embodiment guards against the potential situation where a user accidentally presses a foreign object back into the space between the pad 118 and the sorting head 400 when attempting to retrieve that or another foreign object.

Other post-coin processing foreign object removal measures are implemented in alternative embodiments of the present invention. For example, the coin processing system 100 may include a vacuum for pulling the foreign objects off of the pad 118. An inlet of the vacuum is disposed in the hopper 110. The inlet may include a door that is opened once the vacuum is turned on, but is otherwise closed so that coins do not become jammed in the inlet. When the vacuum is activated, the speed of the rotating pad 118 is lowered (e.g., in the neighborhood of about 50 to about 100 r.p.m.) and the vacuum pulls in the foreign objects as the objects pass by the inlet. According to alternative embodiments of the present invention, the vacuum is activated automatically after processing a batch of coins, or only after a foreign object is detected by one of the above-described detection techniques. The vacuum may be configured such that an object collected by the vacuum is deposited in a box that is accessible by the user for retrieving the object. In one possible configuration, for example, a first vacuum hose may be coupled to the inlet at one end and to the box at a second end. A second hose is coupled to another opening of the box at one end and is coupled to a vacuum pump at the other end. A screen or other filter covers the box-end of the second hose. Thus, the vacuumed objects are pulled to the box and remain in the box.

In another alternative embodiment, the hopper 110 includes a "trap" door. If a foreign object is detected rotating on the pad 118 in the area bounded by the central opening of the sorting head 400, the trap door is opened and a blade is lowered for scooping foreign objects off of the pad 118. The force imparted to the coins via the rotation of the pad 118 causes the foreign objects to travel up the blade and into a chute that directs the objects back to the user. Once the foreign objects are removed, the trap door is closed. Alternatively still, no blade is introduced and the foreign object moves out the trap door and down a chute due to the force imparted to the coins via the rotation of the pad 118.

In yet another alternative embodiment, the pad 118 is moveable in the vertical direction. When the controller 350 determines that a foreign object is on the pad 118, the controller 350 causes the pad 118 to be lowered to increase the spacing between the pad 118 and the sorting head 112. The pad 118 is rotated at a high rate of speed causing the foreign objects to fly off of the pad 118. In such an embodiment, the coin processing system 100 includes a trough disposed around the other periphery of the rotating pad 118 for collecting the objects flung off of the pad 118 and optionally a chute for directing objects collected by the trough back to the user.

Figure 9:
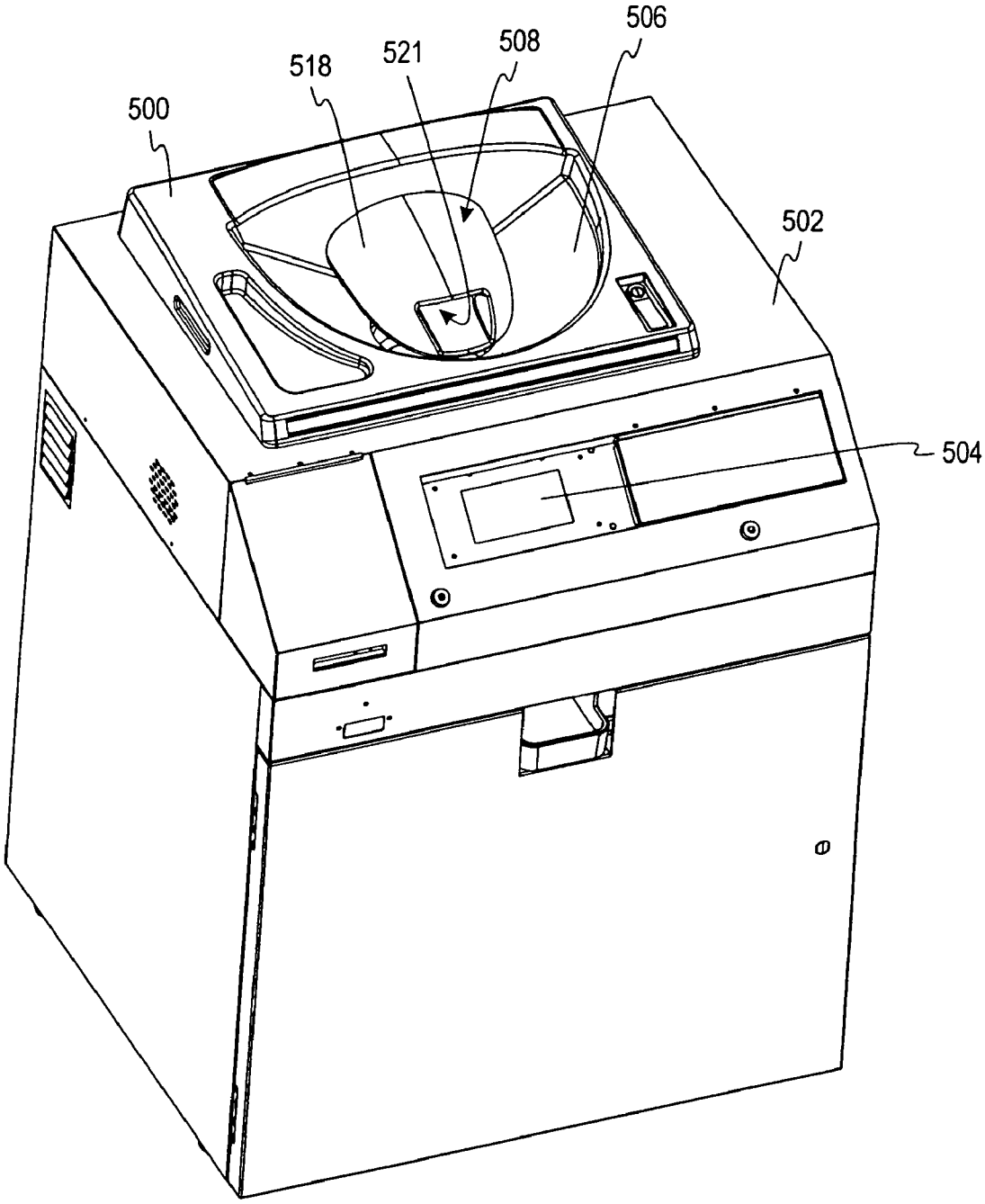
FIG. 9 is a perspective view of a coin redemption machine according to one embodiment of the present invention showing a hood of the gravity-feed tray in a closed/lowered position.
Figure 10:
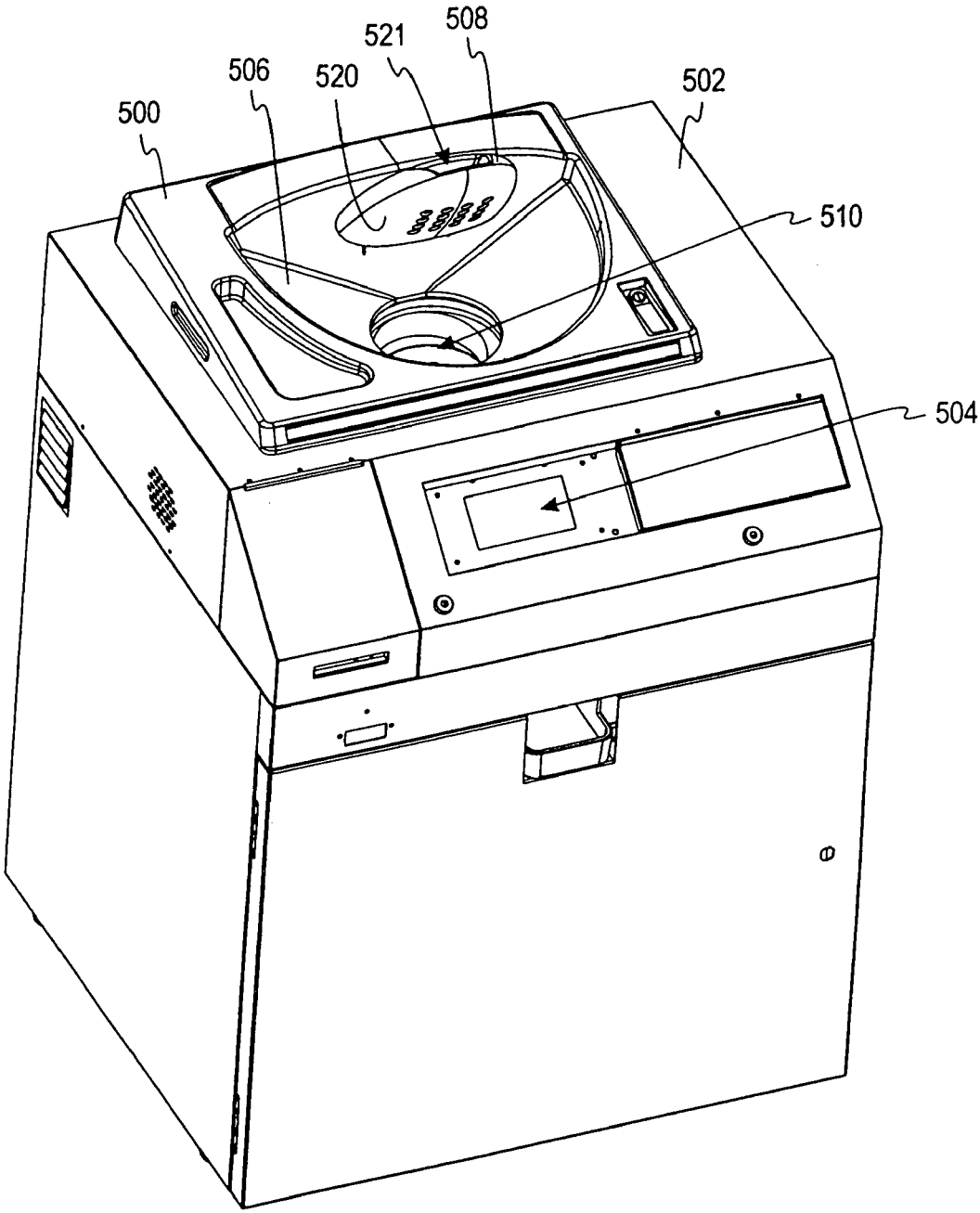
FIG. 10 is a perspective view of a coin redemption machine of FIG. 9 with the hood shown in a open/raised position.
Figure 11A:
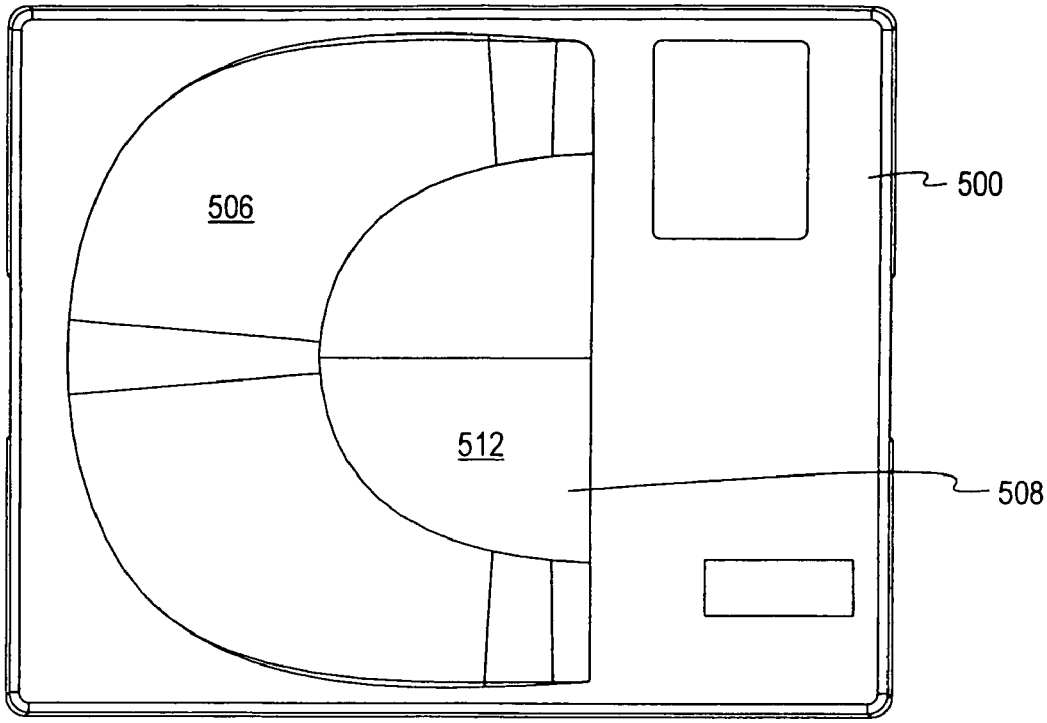
FIGS. 11*a* and 11*b* show top and side views of a gravity-feed coin input tray, respectively, with the hood in a lowered position, according to an alternative embodiment of the present invention.
Figure 11B:
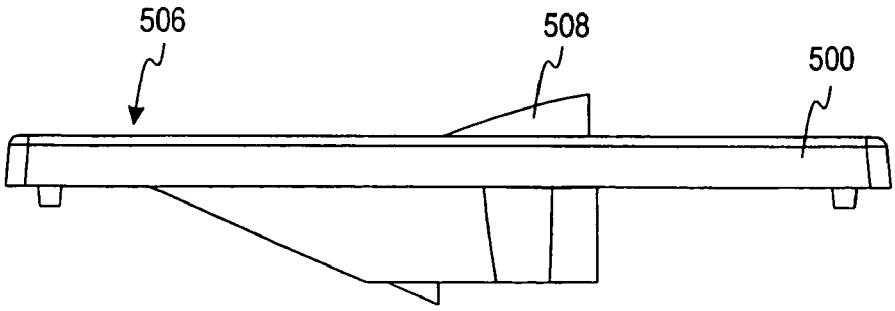
Figure 12A:
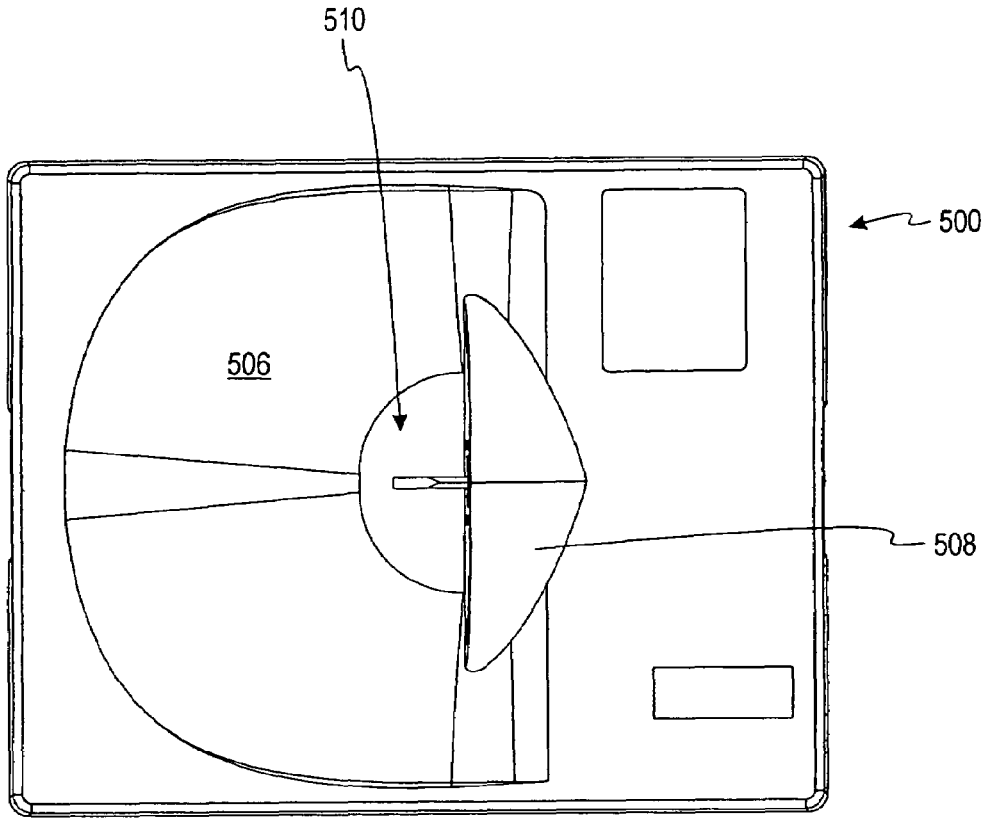
FIGS. 12*a* and 12*b* show top and side views of the gravity-feed coin input tray of FIGS. 11*a* and 11*b* with the hood shown in a raised position.
Figure 12B:
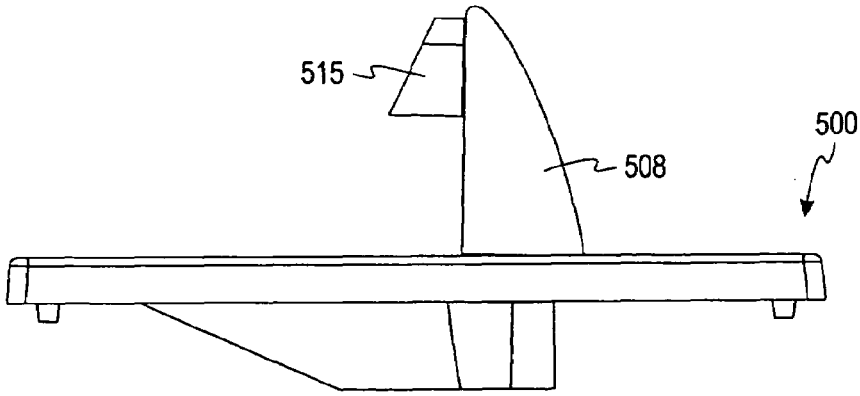

Referring now to FIGS. 8*a*-10 there is shown a gravity-feed coin input tray ("gravity-feed tray") 500 for use with an alternative embodiment of a coin redemption machine 502. In FIGS. 9 and 10, the gravity-feed tray 500 is shown disposed on a coin redemption machine 502. The coin redemption machine 502 includes a display/user-interface 504 and operates in a manner similar to that of the coin redemption machine 10 described in connection with FIGS. 1 and 2. The gravity-feed tray 500 includes a bowl-like portion 506 for receiving coins from a user of the coin redemption machine 502 and a hood 508. The hood 508 is spaced from the bowl-like portion 506 by a distance sufficient to allow coins to flow into the bottom area of the bowl 506 and into an aperture 510 for funneling coins into the hopper 110 of the coin processing system 100 disposed within the redemption machine 502. But the hood 508 is spaced from the bowl-like portion 506 by a distance sufficient to inhibit a user from placing the user's hand(s) into the bottom area of the bowl-like portion 506 or into the aperture 510. According to one embodiment, the distance that the hood 508 is spaced from the bowl-like portion 506 is a distance from about ¼ inch to about 1¼ inch. According to another embodiment, the spacing is adjustable so that the spacing of the hood 508 can be varied.

The upper surface 518 of the hood 508 is downwardly sloped so that coins deposited on top of the hood 508 slide off of the hood 508 and into the bowl-like portion 506 of the gravity-feed tray 500 that directs the coins towards the aperture 510. According to one embodiment of the gravity-feed tray 500, the hood 508 includes magnets for attracting ferric objects before those objects flow along with the coins into the coin processing system of the coin redemption machine 502. For example, magnets are attached to an underside 520 of the hood 508. According to another embodiment, the magnets disposed on the underside 520 of the hood 508 are strong enough to attract ferric objects though the hood 508 such that the ferric objects remain in contract with the upper surface 518 of the hood 508. Alternatively, magnets are embedded in the bowl-like portion 506 of the gravity-feed tray 500 for collecting ferric objects. Alternatively still, the magnets are attached to an outer surface of the bowl-like portion 506 of the gravity-feed tray 500 for pulling ferric objects against the interior surface of the bowl-like portion 506. In yet another alternative embodiment, one or more magnets are disposed within the hood 508 for attracting ferric objects through the hood 508 against the upper surface 518 of the hood 508, the underside 520 of the hood 508, or both.

As shown in FIG. 10, the hood 508 is upwardly rotated to expose the aperture 510 at the bottom of the bowl-shaped portion 506. The hood 508 includes a handle 521 for assisting the user with moving the hood 508. The hood 508 is pivotally attached to the coin tray 500 for providing the user with access to the area of the rotating pad 118 (FIG. 4) bound by the central opening 130 (FIG. 4) for removing foreign objects from the coin processing system 100 (FIG. 3) of the coin redemption machine 502. The position of the hood 508 is monitored by the controller 350 (FIG. 6) via a hood switch 530 (FIG. 6). Optionally and/or alternatively, the hood switch 530 is an interlock switch. If the hood 508 is opened during operation of the coin processing system 100, the controller 350 detects that the hood switch has been tripped and automatically cuts power to the motor 116 driving the rotatable disk, or otherwise suspends the rotation of the rotatable disk.

According to one embodiment of the coin processing system 100, the motor is a DC motor and the controller 350 reverses the current supplied to the DC motor for rapidly stopping the rotation of the disk when the hood switch 530 is tripped. Alternatively, the controller 350 triggers an optional breaking mechanism 357 for rapidly terminating the rotation of the disk 118. The user is alerted via the display 504 that the operation of the coin redemption machine 502 will not resume until the hood 508 is closed.

Referring to FIGS. 11*a*-12*b*, the gravity-feed tray 500 is shown according to an alternative embodiment of the present invention. The hood 512 is shown in the down/lowered position in FIGS. 11*a* and 11*b* and in the up/raised position in FIGS. 12*a* and 12*b*. The gravity-feed tray 500 is similar in many respects to that described in FIGS. 8*a*-10; however, as can been seen in FIGS. 12*a* and 12*b*, the hood 508 of the depicted gravity-feed tray 500 includes a downwardly-projecting-support structure 515, which contacts the interior surface of bowl-like potion 506 to provide support to the hood 508. Often, especially if loaded with a plurality of magnets, the hood 508 can become heavy. This weight, in turn, places stress on the hinge that connects the hood 508 to the tray 500. The forces on this hinge are increased when coins are deposited on top of the hood 508. Thus, the downwardly projecting support structure 515 assists in maintaining the downward/lowered position of the hood 508 while also maintaining the spacing between the hood 508 and the downwardly sloping surface of the bowl-like portion 506 to allow the passage of coins.

The operation of the coin redemption machine 502 will now be described. A user deposits (e.g., dumps) coins into the gravity-feed tray 500 and ferric objects are attracted by magnets attached to the hood 508 of the gravity-feed tray 500 and those objects are optionally collected by the user. The user then instructs the coin redemption machine 502 to commence the processing of the deposited coins via the display/user-interface 504. The coin redemption machine 502 will begin processing the coins if the controller 350 determines the hood 508 is closed-if not, the user is instructed via the interface 504 to lower the hood 508. The coins are then processed by the coin processing system 100 disposed in the coin redemption machine 502. Valid coins are counted and sorted and invalid coins are rejected and returned to the user via the rejected coin receptacle 24 (FIG. 1).

After the controller 350 determines that all of the coins have been processed, it determines whether any foreign objects are present within the coin processing system 100 on the pad 118. The controller 350 begins to monitor the audio signal generated by the microphone 312 to determine whether the audio signal exceeds the stored master ambient sound data. If the stored sound data exceeds a predetermined threshold, the controller 350 generates a foreign object detection signal, informs the user of such via the interface 356, and terminates the rotation of the pad 118. Alternatively, the rotation of the pad is first slowed and the diverter 404 (FIG. 4) is lowered to direct any foreign objects caught between the pad 118 and the sorting head 112 back to the area on the pad 118 bound by the central opening 402. The controller 350 then terminates the rotation of the pad 118. Alternatively, as described above, the pad 118 continues to rotates at a very slow speed with the diverting structure 404 lowered to keep the foreign objects on the pad 118 bound by the central opening 402.

The user is then given the option of retrieving the foreign object(s) from the pad 118 or proceeding directly to having the coin redemption machine 502 issue a receipt. If the user opts not to retrieve the objects, the receipt is issued and the objects remain on the pad 118. If the user elects to retrieve the objects on the pad 118, the user is provided with instructions via the interface 356. The user opens/upwardly-rotates the hood 508 thus exposing the aperture 510 leading from the gravity-feed tray 500 to the hopper 110. Once the hood 508 is opened, the hood switch 530 is tripped and the controller 350 does not resume operation of the redemption machine 502 until the hood 508 is closed and also, optionally, until the user indicates via the interface 504 that the hood 508 is closed. Alternatively, when the hood 508 is opened, the pad 118 continues to rotate at a very slow speed as described above. After the user has retrieved the objects from the pad 118, the user closes (downwardly rotates) the hood 508 causing the hood switch 530 to indicate to the controller 350 that the hood 508 is closed. Optionally, the user may be required to input that the hood 508 is closed via the interface 504. The coin redemption machine 502 then issues a receipt for the transaction. According to an alternative embodiment of the present invention, once the user closes the hood 508, the controller 350 again monitors the microphone 312 for the presence of foreign objects remaining on the pad 118. If the controller 350 detects foreign objects remaining on the pad 118, the user is notified as such.

Figure 13A:
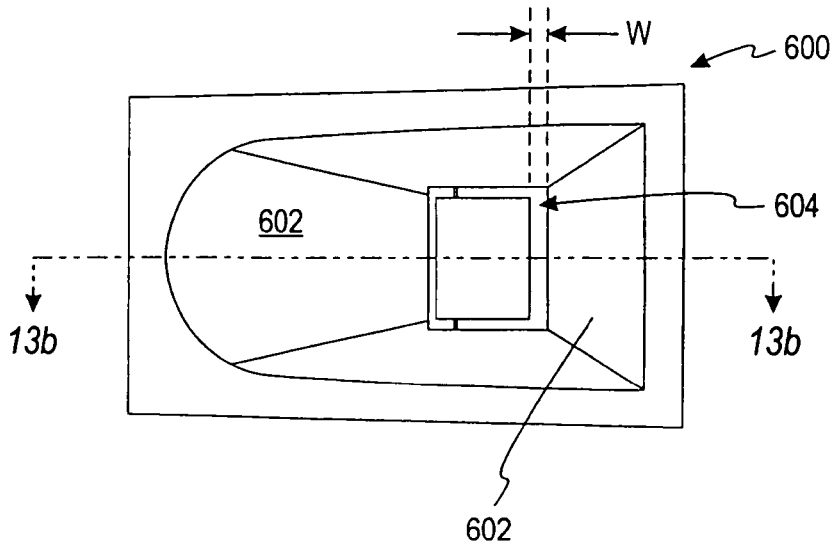
FIG. 13*a* is a top view of a gravity-feed coin input tray according to another alternative embodiment of the present invention.
Figure 13B:
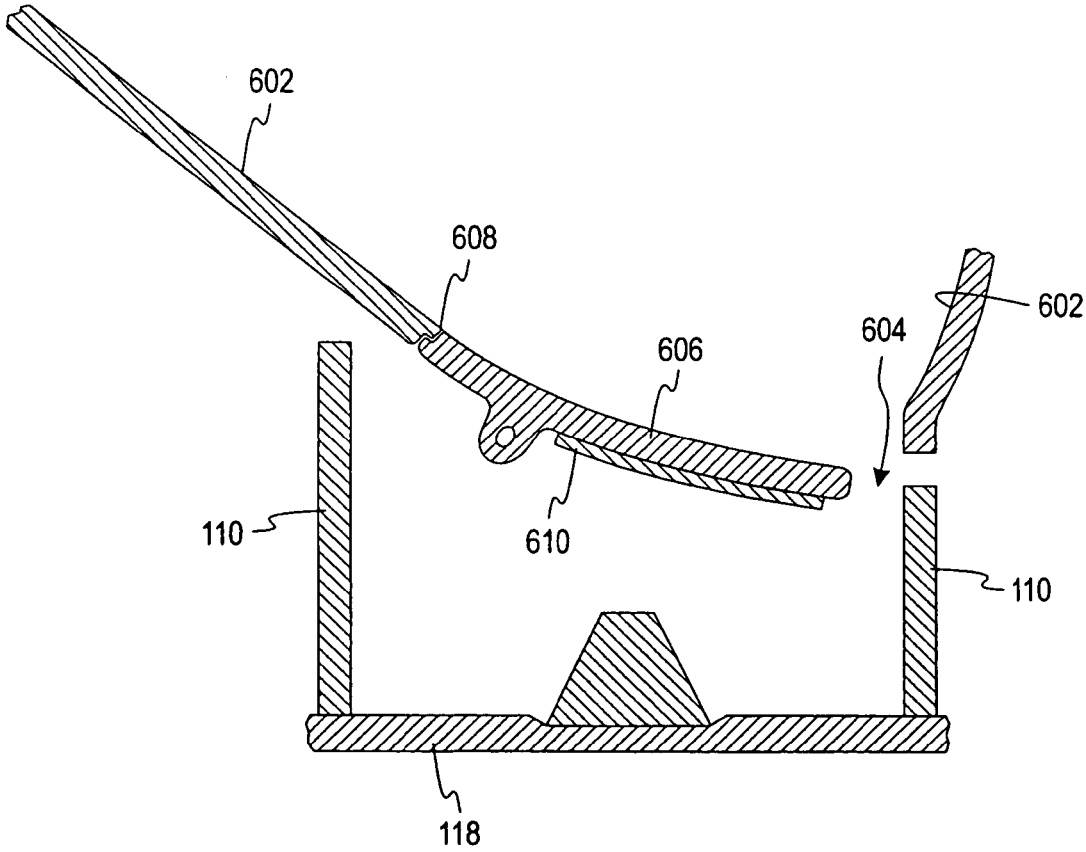
FIG. 13*b* is a sectional view a gravity-feed coin input tray of FIG. 13*a*, taken along line 13*b*.

Referring now to FIGS. 13*a* and 13*b*, a gravity-feed tray 600 is shown according to an alternative embodiment of the present invention. The gravity-feed tray 600 includes a bowl-like portion 602 for funneling coins towards an aperture 604 having a width W disposed towards the bottom of the bowl-like portion 602 of the tray 600. The gravity-feed tray 600 includes a door 606 for allowing access to the pad 118 to remove foreign objects. The user can upwardly rotate the door 606 to remove foreign objects. Downward rotation of the door 606 is prevented by a lip 608 formed in the side wall of the tray 600. Similar to the hood 508 discussed in connection with FIG. 10, the door 606 is equipped with a switch (not shown) for monitoring the positions of the door. Magnets 610 are optionally attached to the door for collecting ferric objects included with the coins.

According to an alternative embodiment of the present invention, the coin redemption machine 502 is equipped with software allowing the coin redemption machine 502 to be operated in two different modes: (i) a self-service mode; and (ii) an operator mode. The self-service mode is as described above wherein a user deposits coins for processing and is issued a receipt for the transaction. The operator mode is designed for an operator of the device who is an employee of the store where the redemption machine 502 is located and has been trained on the use of the redemption machine 502 or is an otherwise experienced operator of the redemption machine 502. In order to instruct the redemption machine 502 to operate in an operator mode, the operator must first input an operator access code via the interface 504. In operator mode, the operator is permitted to make a variety of adjustments to the machine such as instruct the machine to print status reports, control the amount of bag-stops (amount deposited into each bag), balance the machine, shut down the machine, vary the amount of commission charged, change coin bags, or otherwise service the machine.

Operator mode is useful in several respects. First, if a user of the machine is having problems with the machine or is confused how to operate the machine (in self-service mode), the user can summon an operator via the interface. A signal is then sent to the operator via a network connection or via a light (e.g., a flashing light) on the machine. The operator can explain and walk the user through the operation of the machine in user-mode or can access the operator mode to remedy the problem that the user is having.

Second, the operator mode also permits the operator (e.g., an employee of the store where the machine resides) to use the coin redemption machine 502 as a conventional coin processing machine for processing the store's coins. In this situation, the operator enters an operator access code and processes the stores coins without having a commission charged and can change coins bags as they become full. Using the coin redemption machine 502 to process the store's coins saves the store the expense and floor space associated with a conventional coin processing machine.

According to an alternative embodiment of the coin redemption machine 502, an operator when operating the machine pursuant to the operator mode, a "Set-Up" mode, or a "Configuration" mode, can select from various terms (or create their own terms) to be displayed by the coin redemption machine 502 on the display/user-interface 504. The different stores where the machine 502 is located may have varying preferences on how the coin redemption machine 502 refers to various items. For example, one store may prefer the fee charged by the machine be termed a "service fee" while another store may prefer that the fee be termed a commission, a transaction fee, a transaction charge, a coin processing fee, etc. In another example, the stores may prefer that users of the coin redemption machine be addressed with different terms such as client, customer, "Store Name" customer, or "Bank Name" customer. In the operator mode, the operator can select from a list of terms for various items such as the fee and customer name or, alternatively, input a new term not included in the list.

As discussed above, according to one embodiment of the present invention the coin redemption machine 502 charges a commission for use of the machine 502. The receipt issued by the coin redemption machine 502 may reflect the value of the deposited coins, the amount of the commission, and/or the value of the deposited coin amount less the commission. In an alternative embodiment of the present invention, a bonus may be added onto the amount redeemed. For example, a store may desire to have a promotion to attract users into the store whereby by an amount (e.g., a percentage of the coins processed) in addition to the dollar amount of the deposited coins is printed on the receipt issued by the coin redemption machine 502.

The commission charged by the coin redemption machine 502 can be equivalent to a percentage (e.g., 5%, 8%, etc.) of the dollar value of the deposited coins or the commission charged can be a fixed dollar amount (e.g., $1 or $1 for every $10 in coins deposited) in alternative embodiments of the present invention. In other embodiments, the machine 502 can vary the rate charged to customers based on a variety of factors. For example, customers who are considered by the store (where the coin redemption machine is located) to be a preferred customer may be charged a reduced percentage than a customer who is not a preferred customer. A store may consider a customer having a coupon card or a rewards card issued by the store to be a preferred customer. A preferred customer would identify himself or herself to the machine 502 by inserting that customer's coupon/rewards card into the media slot 18. In the banking environment, a bank may consider a customer a preferred customer when that customer maintains a minimum balance in a bank account at that particular bank or that customer maintains a particular type of account.

According to other embodiments of the present invention, the coin redemption machine 502 charges a fee for the use of the machine according to a sliding scale. For example, for all deposits under $10 a fee of $1 is charged, for all deposits between $10 and $20 a fee of 9% of the total is charged, for all deposits between $20 and $50 a fee of 8% is charged, and so on. In other alternative embodiments of the present invention, the commission charged is the greater of either a flat fee or a percentage of the value of deposited coins. For example, the fee may be the greater of $2 or 10% of the value of the deposited coins. Thus where only $5 worth of coins are deposited, a $2 fee would be charged. But, where $30 in coins are deposited, a $3 fee would be charged.

In addition to embodiments described above, several embodiments of the present inventions will now be described.

According to one alternative embodiment of the present invention, a coin redemption machine having a foreign object detection system comprises: (a) a coin input area for receiving coins from a user; (b) a coin processing module for counting the coins received in the coin input area; (c) a microphone disposed in the coin processing module for detecting sound in the coin processing module, the microphone adapted to generate a sound level signal indicative of the amount of sound in the coin processing module; (d) a memory having stored therein master ambient sound level data; and (e) a controller electronically coupled to the microphone and the memory, the controller comparing the sound level signal generated by the microphone to the stored master ambient sound level data, the controller being adapted to generate a foreign object detection signal when the sound level signal does not favorably compare to the stored master ambient sound level data.

According to another alternative embodiment of the present invention, a coin redemption machine having a foreign object removal system comprises: (a) a coin input area for receiving coins from a user; (b) a coin processing module for counting the coins received in the coin input area; and (c) a vacuum having an inlet disposed in the coin processing module for removing foreign objects from the coin processing module. According to yet another alternative embodiment of the present invention, the above-discussed vacuum pulls the foreign objects into an access box that is accessible by a user of the coin redemption machine.

According to still another alternative embodiment of the present invention a coin redemption machine having a foreign object removal system comprises: (a) a coin input area for receiving a plurality of coins from a user; (b) a rotatable disk including a resilient pad for imparting motion to the received plurality of coins; (c) a sorting head having a lower surface generally parallel to and spaced slightly from said resilient upper surface of said disk, said lower surface of said sorting head forming a plurality of coin exit channels for sorting and discharging coins of different denominations; and (d) a diverting structure coupled to the sorting head, the diverting structure movable between a first position wherein the diverting structure is substantially flush with the lower surface of the sorting head and a second position wherein the diverting structures extends downward from the lower surface of the sorting head, in the second position the diverting structured impacting coins and non-coin objects and directing the coins and non-coin objects towards a center of the pad.

According to still another alternative embodiment of the present invention, a gravity-feed coin input tray for a coin redemption machine comprises: (a) a bowl-shaped body having an aperture formed therein towards a base of the bowl-shaped body, the aperture discharging coins to a coin processing system of the coin redemption machine, the bowl-shaped body having an interior surface for funneling coins towards the aperture; and (b) a hood disposed over the aperture in the base of the bowl-shaped body, the hood being spaced from the interior surface of the bowl-shaped body. According to still another alternative embodiment of the present invention, the above-discussed hood is moveable from a first position wherein the hood is disposed over the aperture to a second position wherein the hood is upwardly rotated away from the aperture.

According to still another alternative embodiment of the present invention, a coin redemption machine comprises: (a) a gravity-feed coin input tray for receiving a plurality of coins from a user of the machine, the gravity-feed coin input tray having a bowl-shaped body and an aperture formed therein towards a base of the bowl-shaped body, the bowl-shaped body having an interior surface for funneling coins towards the aperture; (b) a hood pivotally coupled to the gravity feed input tray, the hood pivotally moveable between a first and a second position, the hood being disposed over the aperture in the base of the bowl-shaped body and spaced from the interior surface of the bowl-shaped body when in the first position; the hood being pivoted away from the aperture in the base of the bowl-shaped body when in the second position; (c) a switch for detecting the position of the hood; (d) a coin processing module for counting the coins received in the coin input area, the coin processing module being disposed below the gravity-feed coin input tray, the coin processing module receiving coins funneled through the aperture of gravity-feed coin input tray; and (e) a controller electronically coupled to the switch for monitoring the position of the hood, the controller suspending operation of the coin processing module when the hood is not in the first position.

According to still another alternative embodiment of the present invention, a self-service coin redemption machine comprises: (a) a coin processing module for processing coins received by a user of the device; and (b) means for detecting a foreign object including damaged and bent coins within coin processing module after substantially all of the coins been processed by the coin processing mechanism.

According to still another alternative embodiment of the present invention, a self-service coin redemption machine comprises: (a) a coin processing module for processing coins received by a user of the device; and (b) means for removing one or more foreign object including damaged and bent coins from the coin processing module after substantially all of the coins been processed by the coin processing mechanism.

Figure 14:
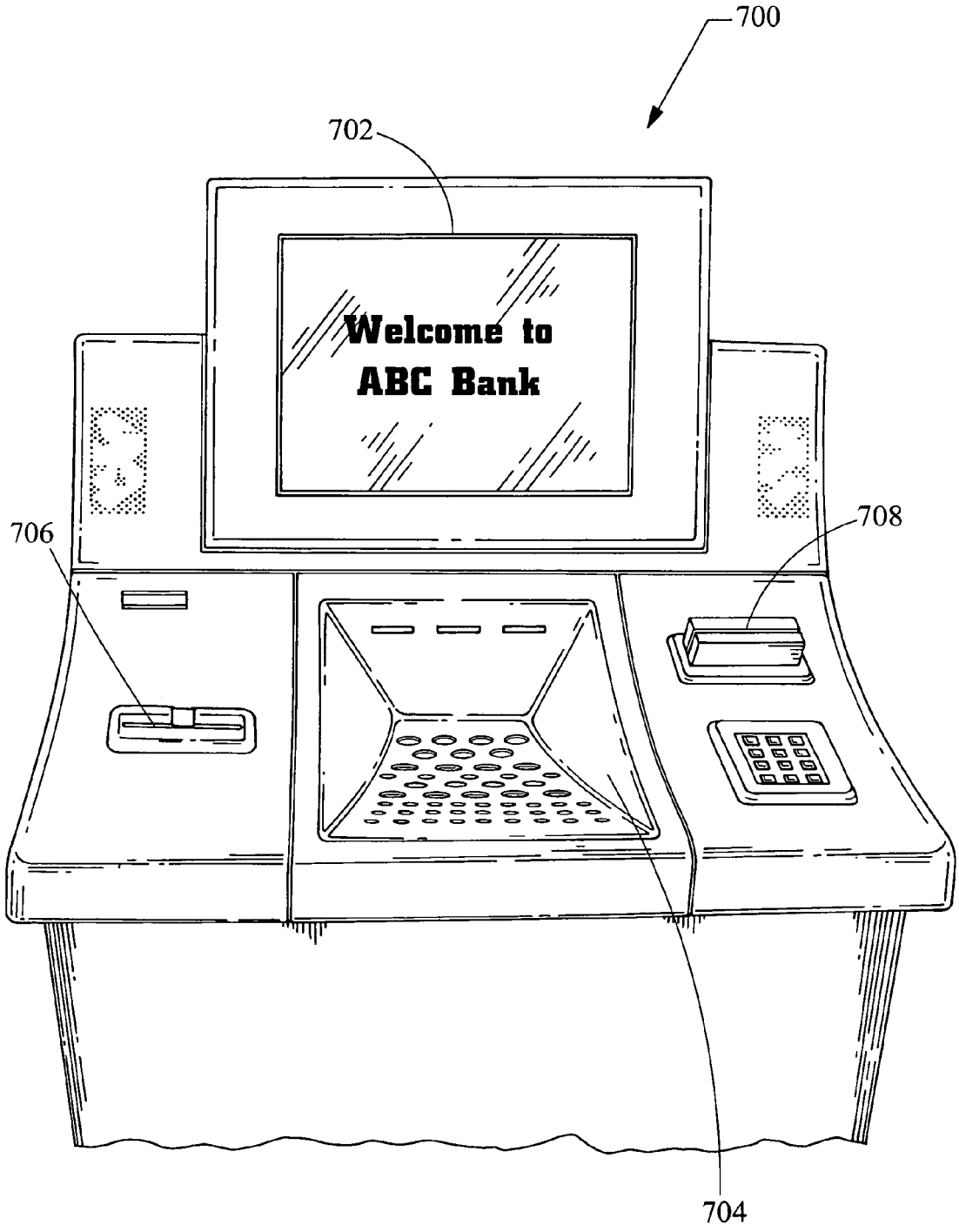
FIG. 14 is a front view illustrating a coin redemption machine according to another alternative embodiment of the present invention.

Referring now to FIG. 14, a coin redemption machine 700 includes a touch screen 702, a coin input receptacle 704, a paper dispensing slot 706, and a media slot 708, in accordance with another embodiment of the present invention. In addition to or instead of the features described below, the coin redemption machine 700 can be used as described above in reference to FIGS. 1-13B.

Figure 15:
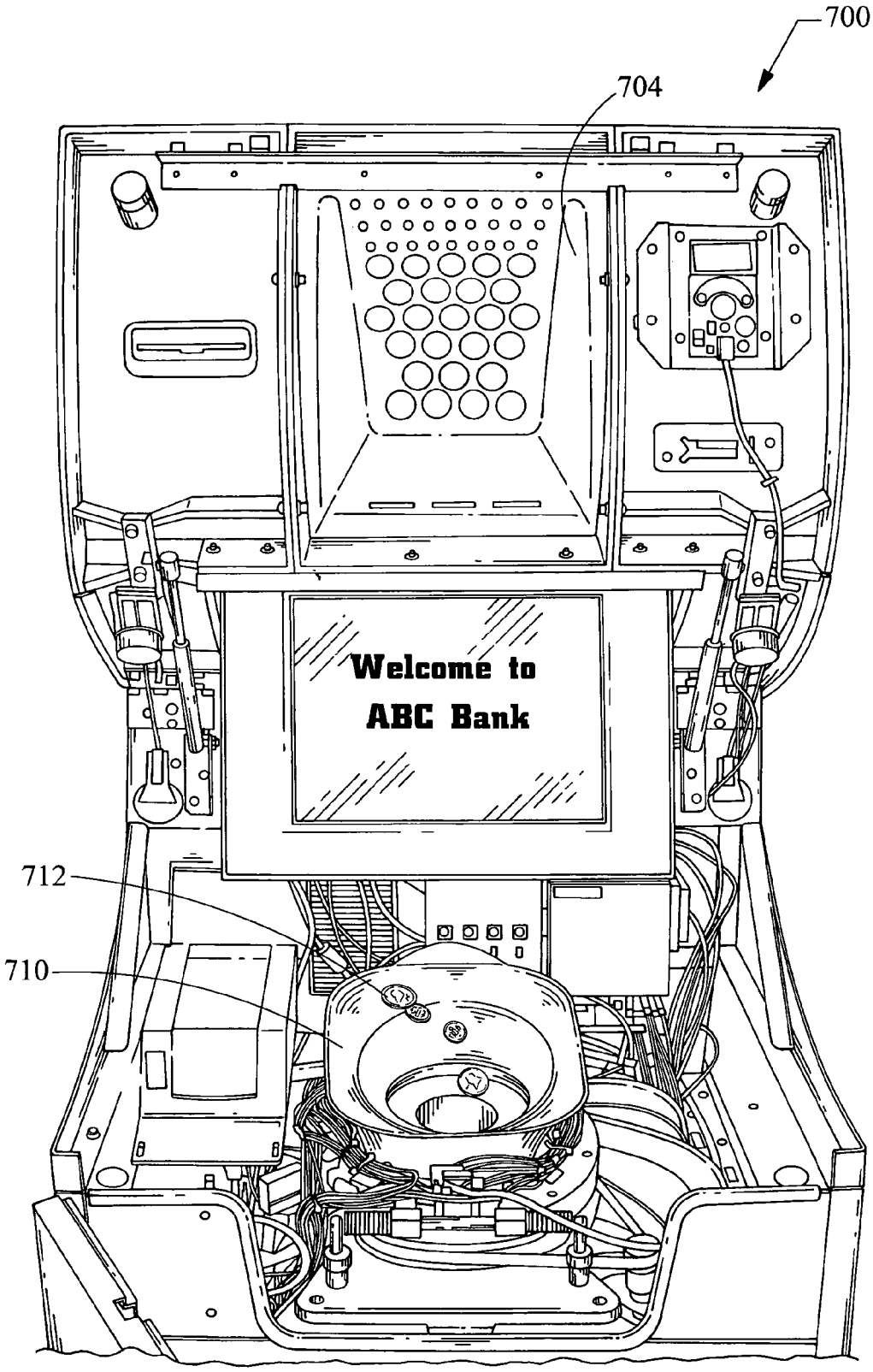
FIG. 15 is a perspective view illustrating internal components of the coin redemption machine of FIG. 14.

Referring now to FIG. 15, a plurality of coins 712 are received from a user in the coin input receptacle 704 when the user brings the coins for processing, e.g., counting, sorting, etc. A cover that includes the coin input receptacle 704 has been lifted to show a coin hopper 710. The coins 712, which have fallen through a plurality of holes, or apertures, in the coin input receptacle 704, are shown inside the coin hopper 710. The coin input receptacle 704, which has been lifted together with the cover of the coin redemption machine, is aligned above the coin hopper 710 when the cover is located in its horizontal position (shown in FIG. 14).

Figure 16:
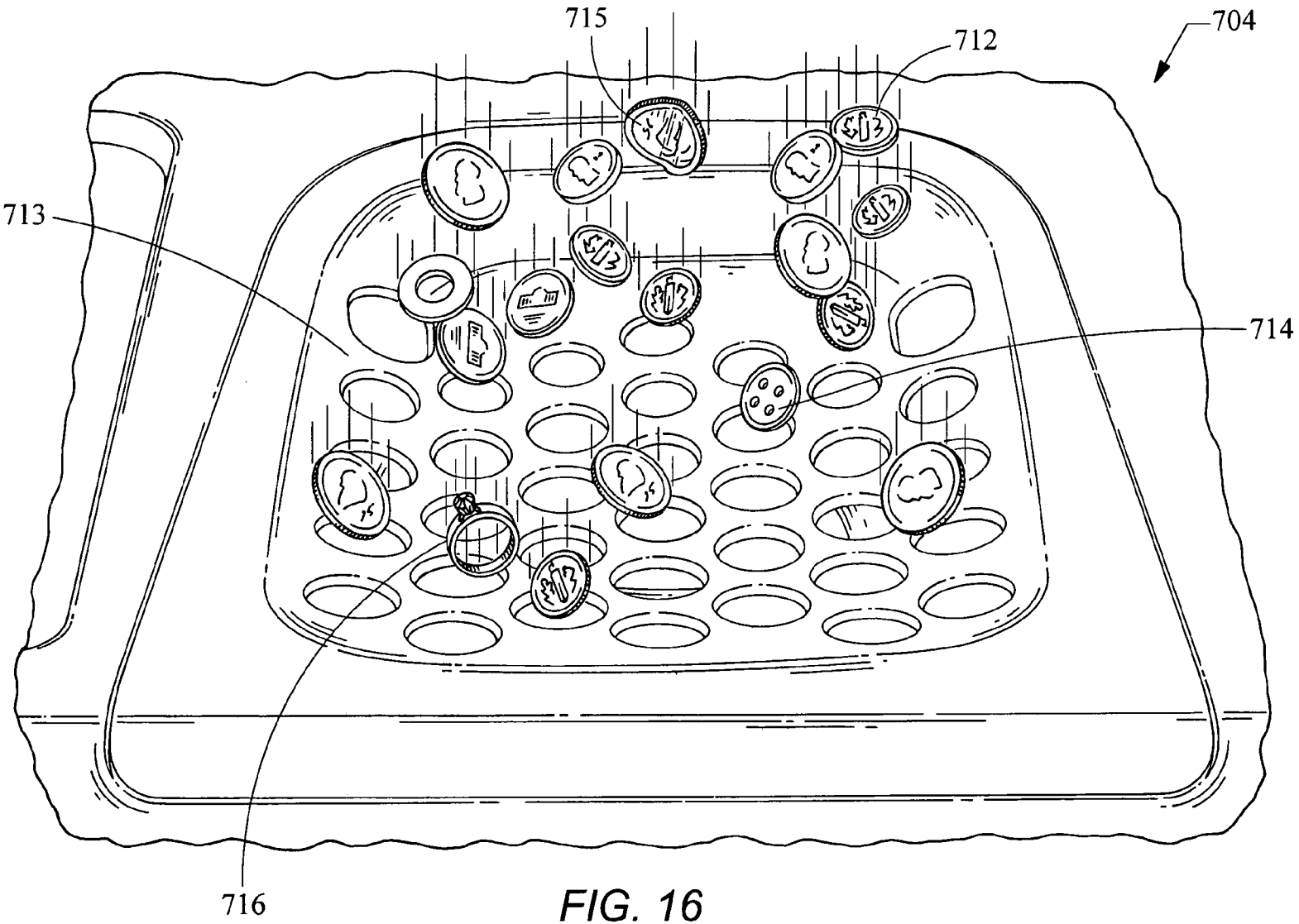
FIG. 16 is a perspective enlarged view illustrating a gravity-feed coin input tray for use with the coin redemption machine of FIG. 14, in accordance with an alternative embodiment of the present invention.

Referring now to FIG. 16, an enlarged view of the coin input receptacle 704 illustrates the action of receiving the coins 712. Included in the coins 712 are foreign, objects, or debris, such as a button 714, a bent coin 715, and a ring 716. Other foreign objects, such as washers, foreign coins, paper clips, and tokens, may also be included with the deposited coins. As the coins 712 are being deposited in the coin input receptacle 704, the coins 712 and the foreign objects 714-716 fall through the plurality of holes that are included in a coin tray 713 of the coin input receptacle 704. The holes of the coin tray 713 are, in general, larger than each of the coins 712 and foreign objects 714-716. Under the force of gravity, the coins 712 and any included debris 714-716 fall into the coin hopper 710. Any foreign objects that are larger than the smallest hole of the coin tray 713 can be easily removed by an operator or user of the coin redemption machine 700. The holes of the coin tray 713 are connected by bumps that cause the coins 712 to tumble through the holes with minimal coin agitation from the user, e.g., a coin pourer.

Figure 17:
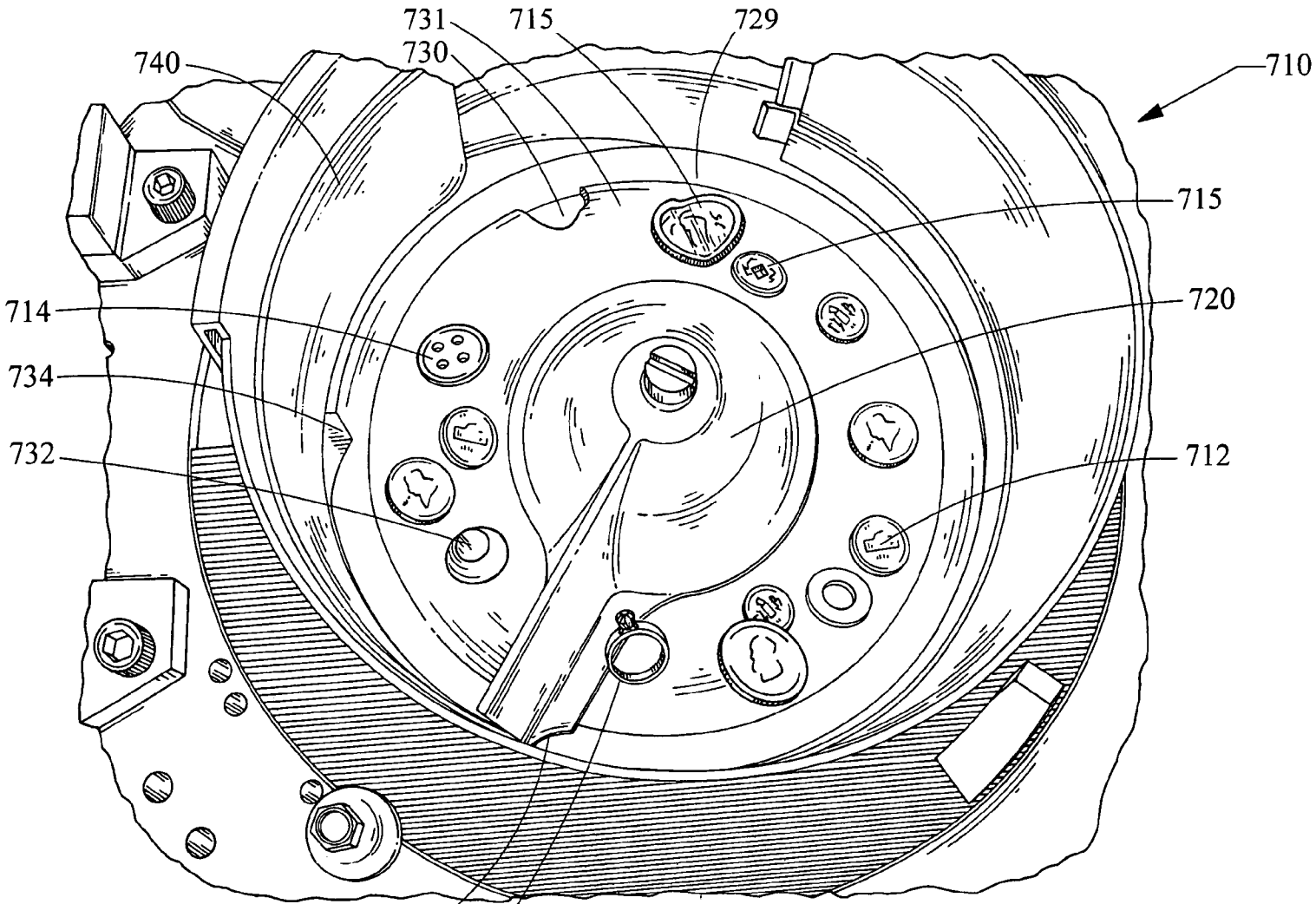
FIG. 17 is a partial perspective view illustrating a coin processing system for use with the coin redemption machine of FIG. 14, in accordance with an alternative embodiment of the present invention.

Referring now to FIG. 17, the coin hopper 710 includes a rotatable blade 720, a sort head 729, a turntable 730 (also known as a rotatable disk), a pad 731, and a hopper wall 740. The blade 720 is mounted in a central location of the turntable 730, and, in general, does not contact the pad 731. In one embodiment, referring to FIG. 3, the sort head 729 is similar to the sorting head 112, the turntable 730 is similar to the rotatable disk 114, and the pad 731 is similar to the pad 118. The blade 720 may, optionally, include a scooping section 722 that extends, adjacent to the turntable 730, from a central mounting location. A bolt is used to mount the blade 720 to the turntable 730. Optionally, the blade 720 can be made from an elastomeric static dissipative material.

As the turntable 730 rotates, for processing the coins 712, the blade 720 is in a disengaged position. Accordingly, when the turntable 730 rotates in a direction associated with the processing of the coins 712 the blade 720 is allowed to move freely, independent of the rotation of the turntable 730. After coins have not been detected via a coin sensor for a predetermined time, the turntable 730 slows down to a predetermined speed that vill impede the coins from entering under the sort head 729. The sorting will stop, reverse direction for one revolution, and resume normal sorting until a predetermined time period. When the coin processing has ended, the turntable 730 rotates in a reverse direction from the direction associated with the coin processing. As the turntable 730 rotates in the reverse direction, the blade 720 is in an engaged position. While in the engaged position, the blade 720 rotates to provide velocity to foreign objects such as the bent coin 715 and the ring 716. In an alternative embodiment, the scooping section 722 can aid in lifting the foreign objects from the turntable 730 as the blade 720 moves the foreign objects to an opening in the hopper wall (which will be described in more detail below).

The turntable 730 includes the pad 731, which is located above the turntable 730. The turntable 730 also includes a protrusion 732, or a bump, which is located between the center of the turntable 730 and the hopper wall 740. Further, the protrusion 732 is positioned between the turntable 730 and the pad 731.

Most objects rotating in the coin hopper 710 move independent of the turntable 730. The objects, such as foreign objects 714-716, are generally in a static position with respect to the turntable 730 only when they pass under the turntable 730, between the turntable 730 and the sort head 720. However, when the objects are positioned above the turntable 30, e.g., on the pad 731, they can move across the pad 731 under the rotational force of the spinning turntable 730.

When reversed, the blade 720 moves at a speed that is generally equal to the speed of the pad 731. To make contact with the blade 720, a debris object 714-716 must be moving (or slipping) with respect to the pad, and must be elevated to the bottom portion of the blade 720. The bottom portion of the blade 720 is the portion of the blade 720 that is closest to the turntable 730. For example, in one embodiment the blade 720 will push an object if the object is moving at a position that is at least about 0.125 inches above the pad. The debris object may be elevated to reach blade height (e.g., the bottom portion of the blade 720) by, for example, making contact with other objects, such as the bump 732, an insert finger 734 (described in more detail below), or another debris object. When the debris object makes contact with another object, the debris object becomes agitated and often loses velocity. Losing velocity, the debris objects slips with respect to the turntable 730, gets elevated to blade level, and is engaged by the blade 720. Then, the blade 720 directs the debris object toward the opening 742 in the hopper wall 740 with enough velocity to make it up a wall ramp 750, which will be described in more detail below.

The coin hopper 710 further includes the insert finger 734 that is fastened to the sort head 729, above the pad 731, and that extends from the hopper wall 740. The finger 734 has a generally triangular shape and a tapered edge. Alternatively, the edge of the finger 734 is a sharp, knife-like edge. When the coins 712 or the foreign objects 714-716 move along the hopper wall 740, the finger 734 agitates or disrupts the static position of the coins 712 and/or of the foreign objects 714-716 relative to the turntable 730. Thus, the finger 734 disrupts the flow of objects positioned near the hopper wall 740 in a similar manner to how the protrusion 732 disrupts the flow of objects located on the turntable 730.

Figure 18:
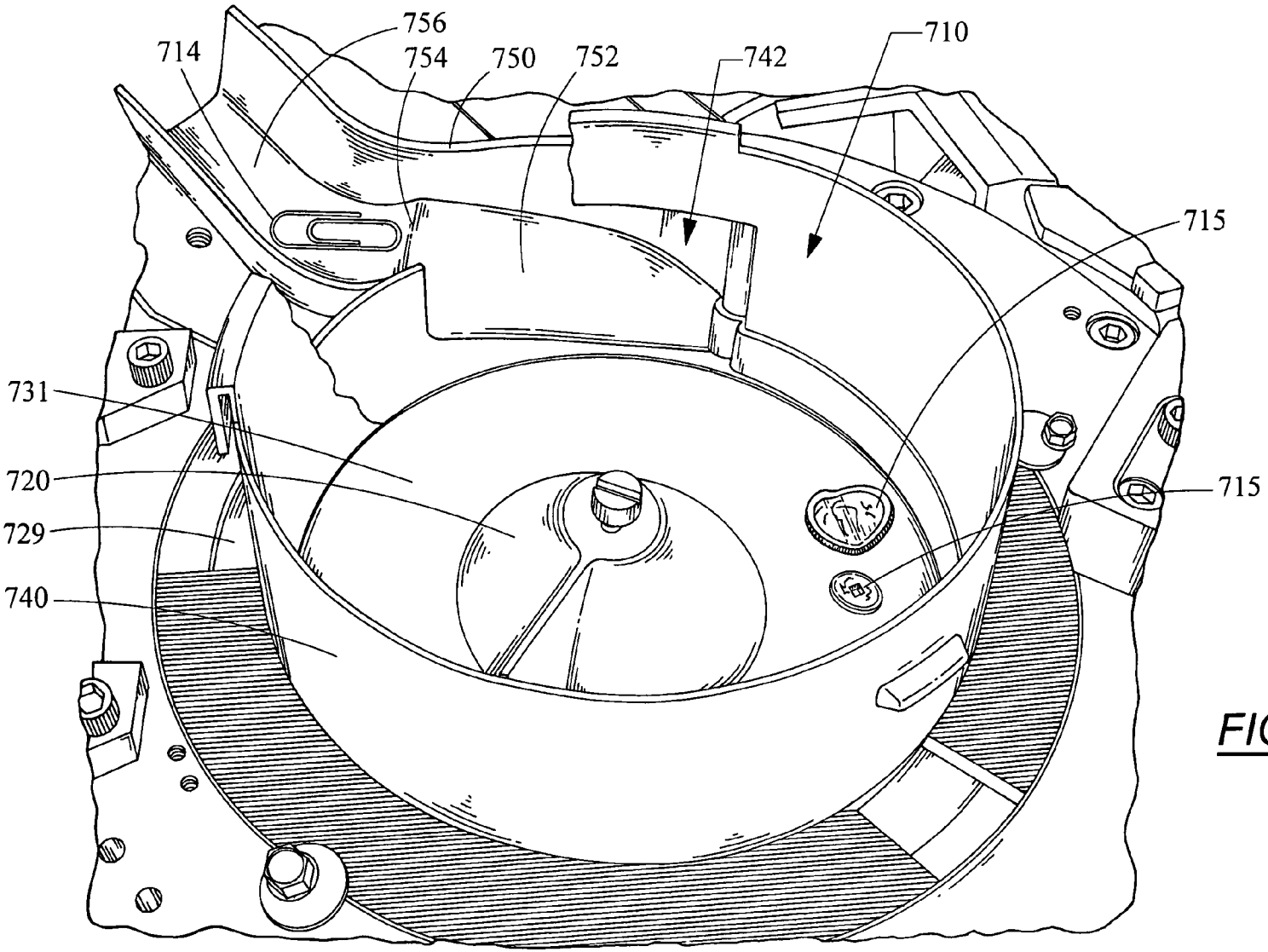
FIG. 18 is a perspective view illustrating the coin processing system of FIG. 17 having an output debris ramp, in accordance with an alternative embodiment of the present invention.

Referring now to FIG. 18, the coin hopper 710 includes the opening 742, which leads to the ramp 750. The opening 742 is generally an aperture in the hopper wall 740 that is designed to allow the removal of foreign objects 714-716 from the coin hopper 710. The opening 742 has a size that is large enough to accommodate a plurality of foreign objects 714-716, for easy removal.

The ramp 750 includes a first section 752 (leading ramp) and a second section 756 (trailing ramp). The leading ramp 752 begins at the hopper wall 740 near the pad 731 of turntable 730, and is slanted upwards. An edge 754, which is generally the highest point of the ramp 750, connects the leading ramp 752 to the trailing ramp 756. The trailing ramp 756 begins at the edge 754 and it ends near a debris receptacle (not shown), which collects debris removed from the coin hopper 710. The trailing ramp 756 is slanted downwards. In general, the ramp 750 is designed to lead the foreign objects 714-716 from the coin hopper 710 to a debris receptacle. Generally, during the sorting process the coins 712 in the coin hopper 710 initially spill onto the ramp 750. Then, as coins are sorted, the coins 712 slide down onto the pad 731 because the volume of the coins 712 diminishes. The edge 754 of the ramp 750 has a height that prevents the coins 712 from exiting the coin hopper 710 during the sorting process. Optionally, the surfaces of one or more of the leading ramp 752, the edge 754, and the trailing ramp 756 are designed to be smooth, to avoid trapping debris on the ramp 750.

When the direction of the turntable 730 is reversed for debris removal, the debris objects 714-716 fall into two categories. A first category includes debris objects 714-716 that have enough velocity to be transported over the edge 754, downward on the trailing ramp 756, and into a debris receptacle. A second category includes debris objects 714-716 that do not have enough velocity to be transported over the edge 754. The debris objects 714-716 fall back onto the pad 731 and will have another opportunity to be removed when the blade 720 engages the objects in a next rotation of the blade 720.

Figure 19:
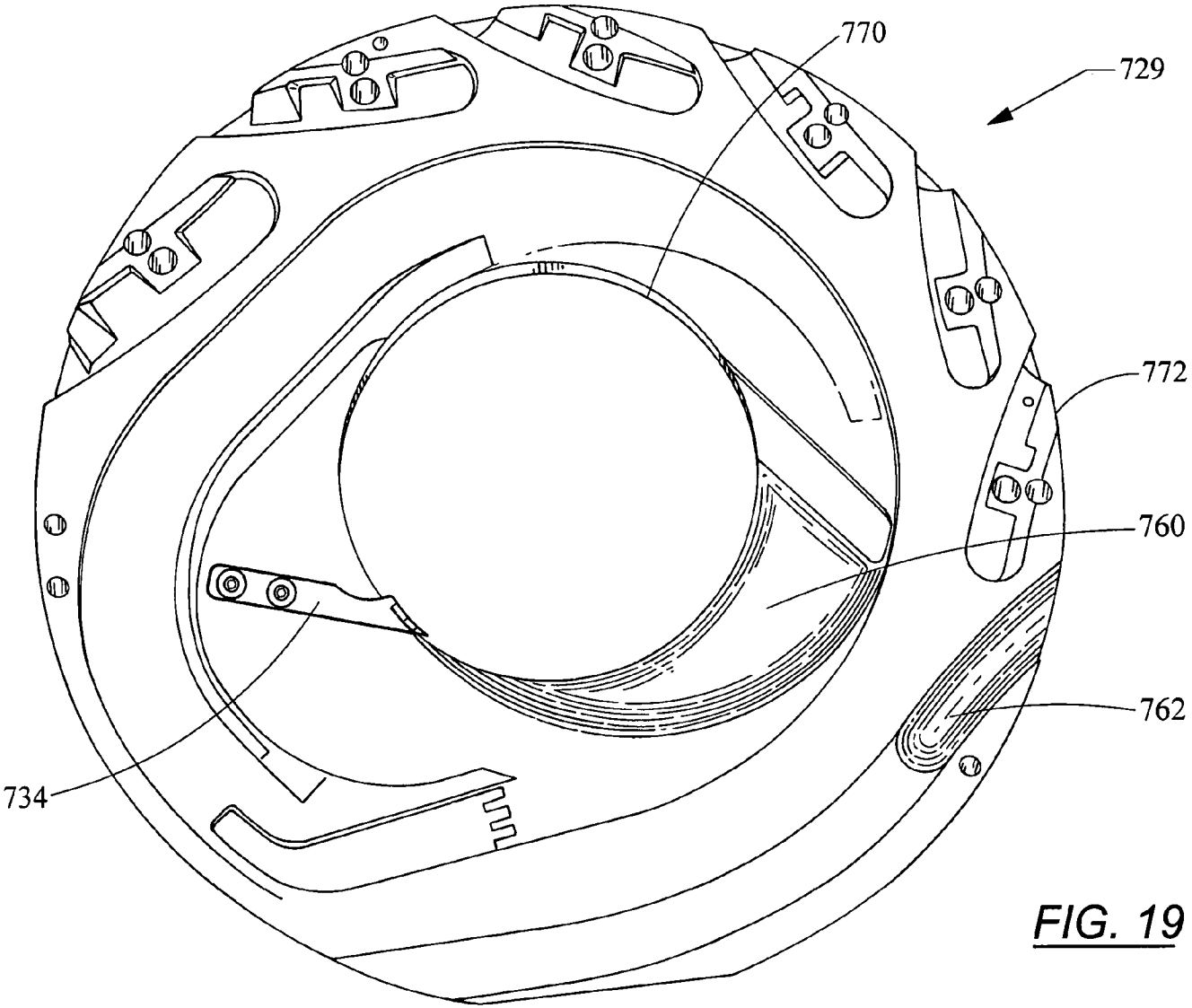
FIG. 19 is a bottom view of a sorting head for use with the coin processing system of FIG. 17, in accordance with an alternative embodiment of the present invention.

Referring now to FIG. 19, the underside of the sort head 729 includes a reversing channel 760 and a debris channel 762. The reversing channel 760 is located near an inner diameter 770 of the sort head 729, and is designed to bring objects back into the center of the coin hopper 710 when the rotation of the turntable 730 is reversed. Coins 712 are generally processed as described above in reference to FIG. 4. Bent coins, and other similar objects, that initially enter an entry channel, such as entry channel 132, may get trapped under the sort head 729 until the rotation of the turntable 730 is reversed. Thus, the reversing channel 760 does not interfere, or inhibit, the flow of coins 712 while the coins 712 are being sorted. After the processing of coins 712 ends, debris objects that are trapped within a defined radius of the sort head 729 are moved back in the coin hopper 710 for removal. The defined radius of the sort head 729 is limited by the dimensions of the reversing channel 760. The movement of the trapped objects is achieved by simply reversing the motion of the turntable 730.

Optionally, the reversing channel 760 is a modified geometry of the entry channel 132. In another embodiment of the present invention, the reversing channel 760 is a continuation of the protrusion 732 in the underside of the sort head 729. The reversing channel 760 can create a disturbance in the initial static position of any trapped objects, the static position of the sort head 729 being relative to the turntable 730, to cause the trapped objects to return into the coin hopper 710. In some instances, the trapped objects may move, or slip, with respect to the pad 731 of the turntable 730. The disturbance caused by the reversing channel 760 can help engage the blade 720.

The debris channel 762 is located near an outer diameter 772 of the sort head 729. In one embodiment, the debris channel 762 is similar in geometry and function to exit channels 261-268 (shown in FIG. 4), except that the debris channel 762 is intended to collect objects that have at least one dimension smaller than the smallest of the coins 712, e.g., a paper clip. The debris channel 762 does not interfere with the flow of coins 712 while the coins 712 are being sorted. In general, the debris channel 762 helps to remove foreign objects during the processing of the coins 712. Thus, small objects that are not being diverted to any exit channels, such as exit channels 261-268, are diverted to the debris channel 762 for removal to a debris reservoir (not shown). The debris channel 762 is the first exit that the objects deposited in the coin hopper 710 will encounter during the sorting process. If the object fits within the debris channel 762, then, the object will exit via the debris channel 762. Alternatively, an object that does not exit via the debris channel 762 may exit via any of the other channels.

The timing, speed, and direction of the rotating turntable 730 are optionally controlled through software. In one embodiment of the present invention, the timing, speed, and direction of the blade 720 are independent of software. Alternatively, one or more of the timing, speed, and direction of the blade 720 can be controlled through software. In general, the software controls a sorting period, an interim period, and a post-sort period of the coin hopper 710. The sorting period insures that all the good coins of coins 712 have been sorted. In the sorting period, the turntable 730 rotates in the normal direction, while the blade 720 is in the disengaged position (as described above).

The interim period begins when a coin has not been counted for a predetermined time period, e.g., five seconds. During the interim period, the blade 720 reverses for a predetermined number of degrees, such as 360 degrees (one full revolution). The interim period provides an opportunity to free, or dislodge, coins that are trapped between the blade 720 and the hopper wall 740. Then, the turntable 730 reverts to its sorting mode.

In the post-sort period, the direction of the turntable 730 is reversed and the blade 720 is in the engaged position. The post-sort period begins at the end of a predetermined period of time during which no coins have been sorted. The duration of the post-sort period and the debris velocity is controlled by selecting an appropriate turntable velocity for a predetermined time period.

Optionally, a plurality of stages can be used during the post-sort period, each stage having a different speed for optimizing the removal of the debris. For example, in a first stage of the post-sort period the speed of the turntable 730 is generally slower (near sort speed), wherein any foreign objects must be agitated from a static position relative to the turntable 730, while in a second stage of the post-sort period the speed of the turntable 730 can be increased, wherein the foreign objects are now in a dynamic position relative to the turntable 730. The timing and speed during the post-sort period are controlled to maximize the removal of all foreign objects, including foreign objects trapped within the coin hopper 710 and in the reversing channel 760.

While the invention is susceptible to various modifications and alternative forms, specific embodiments have been shown by way of example in the drawings and described in detail herein. It should be understood, however, that the invention is not intended to be limited to the particular forms disclosed.

What is claimed is:

1. A coin processing system, comprising:

a coin input area for receiving coins from a user, the coins being mixed with at least one foreign object; and a coin processing module for receiving and counting the coins from said coin input area, said coin processing module including a rotatable disk having an upper surface, a sort head having a plurality of coin sorting channels, said sort head being located such that it forms a gap with said upper surface rotatable disk, the coins entering the coin sorting channels through said gap, a coin hopper for receiving the coins from said coin input area, said coin hopper being defined by said rotatable disk on its bottom surface and by a peripheral wall surrounding a central area of said sort head, said coin sorting channels being formed outside said peripheral wall, and a foreign object removal system being located at least partially within said coin hopper for removing said foreign object located in said central area within said peripheral wall of said coin hopper, said foreign object being removed from said coin hopper only after all the coins have been removed from said central area within said peripheral wall, said foreign object being elevated above said rotatable disk and removed from within said coin hopper along a path directing said foreign object from said upper surface of said rotatable disk to a rejection outlet that is located above said gap formed between said sort head and said rotatable disk.

2. The coin processing system of claim 1, wherein the coin processing system is a coin-redemption-type coin-processing system.

3. The coin processing system of claim 1, wherein the coin input area comprises a gravity feed coin input tray.

4. The coin processing system of claim 1, wherein said coin input area is a coin tray having holes for allowing said coins to fall through to said coin hopper.

5. The coin processing system of claim 1, wherein said rotatable disk has a resilient pad for imparting motion to said coins in said coin hopper, said resilient pad forming said upper surface of said rotatable disk, said object removal system including a blade mounted to said rotatable disk for removing said foreign object from said coin hopper.

6. The coin processing system of claim 5, wherein said blade is rotatable in an opposite direction to a sorting direction of said rotatable disk, said blade providing velocity to said foreign object.

7. The coin processing system of claim 5, wherein said blade includes a first state and a second state, said first state having said blade rotate in an opposite direction to said rotatable disk, said second state having said blade in a fixed position with respect to said rotatable disk when said rotatable disk is rotated in a reversed direction, said blade imparting velocity to objects that slip on said rotatable disk when said blade is in said second state.

8. The coin processing system of claim 5, wherein said blade is made at least in part from an elastomer material.

9. The coin processing system of claim 1, wherein said rotatable disk has a resilient pad for imparting motion to said coins in said coin hopper, said resilient pad forming said upper surface of said rotatable disk, said pad including a protrusion for elevating said foreign object from said pad.

10. The coin processing system of claim 1, wherein said foreign object removal system includes a ramp for allowing said foreign object to exit said coin hopper along said path.

11. The coin processing system of claim 10, wherein said ramp includes a first section that intersects a said peripheral wall of said coin hopper at a start point of said first section, said first section having an upward slope for hindering the movement of a coin beyond an end point of said first section.

12. The coin processing system of claim 11, wherein said ramp includes a second section having a start point that connects to said end point of said first section, said second section having a downward slope for allowing said foreign object to move to a foreign object collecting tray.

13. The coin processing system of claim 1, wherein said foreign object removal system includes a finger for agitating and lifting said foreign object in said coin hopper.

14. The coin processing system of claim 13, wherein said finger is located near said peripheral wall of said coin hopper and extends therefrom above said rotatable disk, said finger having a tapered end.

15. The coin processing system of claim 1, wherein said rotatable disk has a resilient pad for imparting motion to said coins in said coin hopper, said resilient pad forming said upper surface of said rotatable disk, said rotatable disk having a timing and a speed controlled through software.

16. The coin processing system of claim 15, wherein said rotatable disk has an interim stage for dislodging trapped coins, said rotatable disk having a slower speed and spinning in a reverse direction during said interim stage than in a sorting stage of said rotatable disk.

17. The coin processing system of claim 15, wherein said timing and said speed are controlled to define a post-son period to insure that all good coins have been sorted.

18. A coin processing system, comprising:

a coin input area for receiving a plurality of coins from a user, the coins being mixed with one or more foreign objects;

a rotatable disk including a resilient upper surface in the form of a pad for imparting motion to the plurality of coins in said coin hopper, said pad forming a bottom surface of said coin hopper;

a sorting head having a lower surface generally parallel to and spaced slightly from said resilient upper surface of said disk via a gap, said lower surface of said sorting head forming a plurality of channels for sorting and discharging coins of different denominations;

a coin hopper for receiving said plurality of coins from said coin input area, said coin hopper being defined on its bottom by said rotatable disk and around its periphery by a peripheral wall located in a central portion of said sorting head, said plurality of channels extending from said peripheral wall in a direction away from said central portion; and a debris removal system for removing at least one of said one or more foreign objects directly from an area within said peripheral wall of said coin hopper only after all the coins have been separated within said area from said one or more foreign objects, at least one of said one or more foreign objects being elevated above said disk to be removed via a hopper exit that is located in said peripheral wall of said coin hopper and above said gap formed between said lower surface of said sorting head and said resilient upper surface of said disk.

19. The coin processing system of claim 18, wherein said plurality of channels includes at least one of a reversing channel and a debris channel, said reversing channel trapping another one of said one or more foreign objects when said coins are being sorted, said debris channel diverting said another one of said one or more foreign objects to a debris reservoir when said coins are being sorted.

20. The coin processing system of claim 19, wherein said debris channel accepts said another one of said one or more foreign objects only if said another one of said one or more foreign objects has at least one dimension that is smaller than a diameter of the smallest of said coins.

21. The coin processing system of claim 19, wherein said debris channel is a first channel exit, among said plurality of channels, for said another one of said one or more foreign objects.

22. A method for removing foreign objects in a coin processing system, the method comprising:

providing a mix of at least one foreign object and a plurality of coins in a coin input area of a coin processing system;

receiving the coins and said foreign object from said coin input area in a coin hopper of a coin processing module, said coin hopper being defined on its bottom by a rotatable disk and around its periphery by a peripheral wall surrounding a central portion of a sorting head, said sorting head being spaced slightly from said rotatable disk via a gap through which coins exit said coin hopper to enter a plurality of channels formed on a lower surface of said sorting head, said plurality of channels being for sorting and discharging coins of different denominations and extending from said peripheral wall in an outward direction away from said central portion of said sorting head counting the coins from said coin hopper in a coin processing area of said coin processing module, the coin processing area including said plurality of channels of said sorting head;

removing said foreign object directly from said central portion surrounded by said peripheral wall of said coin hopper subsequent to receiving said foreign object from said coin input area and subsequent to said counting of said coins in said coin processing area; and elevating said foreign object to exit from said central portion surrounded by said peripheral wall of said coin hopper along a path that begins on an upper surface of said rotatable disk and continues above said gap formed between said sorting head and said rotatable disk.

23. The method of claim 22, further comprising collecting ferric foreign objects provided with said plurality of coins in said coin input area.

24. The method of claim 22, further comprising allowing said coins to fall through holes of said coin input area to said coin hopper.

25. The method of claim 24, further comprising using bumps between said holes of said coin input area to cause said coins to tumble with minimal coin agitation from a coin pourer.

26. The method of claim 22, further comprising:

imparting motion to said coins in said coin hopper via a rotatable disk having a resilient pad of said rotatable disk; and rotating a blade in a reverse direction for removing said foreign object from said coin hopper, said reverse direction being an opposite direction to a sorting direction of said rotatable disk.

27. The method of claim 22, further comprising:

imparting motion to said coins in said coin hopper via a resilient pad of said rotatable disk; and elevating said foreign object from said pad via a protrusion included in said pad.

28. The method of claim 22, further comprising allowing said foreign object to exit said coin hopper via a ramp of a foreign object removal.

29. The method of claim 28, further comprising preventing the movement of a coin beyond a predetermined location of said ramp.

30. The method of claim 28, further comprising collecting said foreign object in a foreign object collecting tray.

31. The method of claim 22, further comprising agitating said foreign object via a finger of a foreign object removal system.

32. The method of claim 22, further comprising trapping said foreign object in a reversing channel when said coins are being processed, said reversing channel being one of a plurality of channels included in said sorting head.

33. The method of claim 32, further comprising rotating said rotatable disk in a reverse direction for moving said foreign object back to said hopper.

34. The method of claim 22, further comprising diverting said foreign object to a debris reservoir via a debris channel when said coins are being processed, said debris channel being one of a plurality of channels included in a sorting head of said coin processing module.

35. The method of claim 34, further comprising accepting said foreign object in said debris channel only if said foreign object has at least one dimension that is smaller than a diameter of the smallest of said coins.

36. A method for removing debris in a coin processing system, the method comprising:

receiving a mix of debris and a plurality of coins in a coin hopper of a coin processing module, said plurality of coins being received from a coin input area of a coin processing system;

imparting motion to the coins in said coin hopper using a rotatable disk of said coin processing module, said rotatable disk defining a bottom surface of said coin hopper;

sorting the coins according to coin denomination using a plurality of channels formed on an underside surface of a sorting head, said sorting head being separated by a gap from said rotatable disk, said plurality of coins entering said plurality of channels through said gap;

separating said debris from said plurality of coins, said debris being leftover within an area defined by a peripheral wall of said coin hopper, said peripheral wall being in a central portion of said sorting head and defining generally a starting point of said plurality of channels as they extend outwards from said peripheral wall in a direction away from a center of said sorting head; and after sorting all the coins, removing debris leftover on said rotatable disk via an exit of said coin hopper that is located above said gap formed between said sorting head and said rotatable disk.

37. The method of claim 36, further comprising controlling said rotatable disk via software.

38. The method of claim 37, wherein said controlling step includes providing a post-sort period to insure that all good coins have been sorted, said post-sort period including reversing a sorting direction of said rotatable disk to remove said debris from said coin hopper.

39. The coin processing system of claim 36, further comprising trapping debris in a reversing channel of said plurality of channels when the coins are being sorted.

40. The coin processing system of claim 36, further comprising diverting debris in a debris channel of said plurality of channels when the coins are being sorted.

* * * * *

UNITED STATES PATENT AND TRADEMARK OFFICE

CERTIFICATE OF CORRECTION

PATENT NO. : 7,438,172 B2
APPLICATION NO. : 11/267090
DATED : October 21, 2008
INVENTOR(S) : Arthur J. Long et al.

It is certified that error appears in the above-identified patent and that said Letters Patent is hereby corrected as shown below:

In Column 22, Claim 17, please replace Lines 52-54 with the following:

-- 17. The coin processing system of claim 15, wherein said timing and said speed are controlled to define a post-sort period to insure that all good coins have been sorted. --

Signed and Sealed this

Seventeenth Day of March, 2009

John Doll

JOHN DOLL
*Acting Director of the United States Patent and Trademark Office*